US007614913B2

(12) United States Patent
Ice

(10) Patent No.: US 7,614,913 B2
(45) Date of Patent: Nov. 10, 2009

(54) CONNECTOR RECEPTACLE WITH RECEPTACLE EMI SHIELD

(75) Inventor: Donald A. Ice, Milpitas, CA (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 12/163,894

(22) Filed: Jun. 27, 2008

(65) Prior Publication Data

US 2009/0004915 A1 Jan. 1, 2009

Related U.S. Application Data

(60) Provisional application No. 60/946,838, filed on Jun. 28, 2007, provisional application No. 60/972,725, filed on Sep. 14, 2007.

(51) Int. Cl.
*H01R 13/648* (2006.01)

(52) U.S. Cl. ..... 439/607.05; 439/607.55; 439/607.53; 439/607.2

(58) Field of Classification Search ..... 439/607.04, 439/607.05, 607.07, 607.2, 607.21, 607.53, 439/607.55

See application file for complete search history.

(56) References Cited

U.S. PATENT DOCUMENTS

| | | | | |
|---|---|---|---|---|
| 5,257,949 | A * | 11/1993 | Paulus | 439/620.1 |
| 7,540,773 | B2 * | 6/2009 | Ko | 439/581 |
| 7,543,995 | B2 * | 6/2009 | Ice | 385/92 |
| 2004/0032714 | A1 * | 2/2004 | Ice | 361/686 |
| 2009/0004917 | A1 * | 1/2009 | Ice | 439/610 |

* cited by examiner

*Primary Examiner*—James Harvey
(74) *Attorney, Agent, or Firm*—Workman Nydegger

(57) ABSTRACT

An electrical connector receptacle that includes receptacle-side electrical contacts, a socket, and a receptacle shield. The socket is configured such that a connector may be inserted therein allowing the electrical contacts of the connector to interface with the receptacle-side electrical contacts. The receptacle shield is placed in the back of the receptacle, and is composed of an Electro-Magnetic Interference barrier material. In one embodiment, the receptacle shield is configured to interface with an EMI barrier of the connector, and includes separate slots through which electrical connections may pass.

15 Claims, 25 Drawing Sheets

CONNECTOR RECEPTACLE WITH RECEPTACLE EMI SHIELD

CROSS-REFERENCE TO RELATED APPLICATIONS

This application claims priority to U.S. provisional patent application Ser. No. 60/946,838 filed Jun. 28, 2007, and to U.S. provisional patent application Ser. No. 60/972,725 filed Sep. 14, 2007, which provisional applications are both incorporated herein by reference in their entirety.

BACKGROUND

Communication technology has transformed our world. As the amount of information communicated over networks has increased, high speed transmission has become ever more critical. High speed communications often rely on the presence of high bandwidth capacity links between network nodes. There are both copper-based solutions and optical solutions used when setting up a high bandwidth capacity link. A link may typically comprise a transmitter that transmits a signal over a medium to a receiver, either in one direction between two network nodes, or bi-directionally. An optical link might include, for example, an optical transmitter, a fiber optic medium, and an optical receiver for each direction of communication. In duplex mode, an optical transceiver serves as both an optical transmitter that serves to transmit optically over one fiber to the other node, while receiving optical signals over another fiber (typically in the same fiber-optic cable).

Presently, communication at more than 1 gigabit per second (also commonly referred to as "1 G") links are quite common. Standards for communicating at 1 G are well established. For instance, the Gigabit Ethernet standard has been available for some time, and specifies standards for communicating using Ethernet technology at the high rate of 1 G. At 1 G, optical links tend to be used more for longer spanning links (e.g., greater than 100 meters), whereas copper solutions tend to be used more for shorter links due in large part to the promulgation of the 1000Base-T standard, which permits 1 G communication over standard Category 5 ("Cat-5") unshielded twisted-pair network cable for links up to 100 m.

More recently, high-capacity links at 10 gigabits per second (often referred to in the industry as "10 G") have been standardized. As bandwidth requirements increase, potential solutions become more difficult to accomplish, especially with copper-based solutions. One copper-based TOG solution is known as 10 GBASE-CX4 (see IEEE Std 802.3ak-2004, "Amendment: Physical Layer and Management Parameters for 10 Gb/s Operation Type 10 GBASE-CX4" Mar. 1, 2004), which accomplishes the higher bandwidth, despite the use of copper. 10 GBASE-CX4 uses a cable, which includes 4 shielded differential pairs carrying a quarter of the bandwidth in each direction, for a total of 8 differential copper pairs. This cable is quite bulky (typically about 0.4" or 10 mm in diameter) and expensive to make and cannot be terminated in the field (as can CAT-5 for example). Furthermore, this copper-based 10 G solution is limited to distances of about 15 m without special efforts. Alternative copper-based 10 G solutions are being developed and standardized but are likely also to require significant power consumption. The primary example is known as 10 GBASE-T under development in the IEEE (see IEEE draft standard 802.3an, "Part 3: Carrier Sense Multiple Access with CollisionDetection (CSMA/CD) Access Method and Physical Layer Specifications Amendment: Physical Layer and Management Parameters for 10 Gb/s Operation, Type 10 GBASE-T" 2006). This standard uses CAT5e or CAT6A unshielded twisted pair cable for distances to 55 m and 100 m respectively. However it is expected that because of the extremely complex signal processing required, this standard will require circuitry with very high power dissipation, initially as high as 8-15 Watts (per port and thus twice this per link). A lower power variant which only achieves 30 m on CAT6A cable is still expected to be more than 4 Watts per port. These high power levels represent both a significant increase in operating costs and perhaps more importantly, limitations on the density of ports which can be provided on a front panel. For example, power dissipations of 8-15 W could limit port density to 8 ports or less in the space of a typical 1 U rack unit, whereas 1000BASE-T and TG optical interfaces such as the SFP transceiver can provide up to 48 ports in the same space. Nevertheless, because of the cost of present day optical solutions at 10 G, there remains interest in this copper solution.

BRIEF SUMMARY

Embodiments described herein related to an electrical connector receptacle that includes receptacle-side electrical contacts, a socket, and a receptacle shield. The socket is configured such that a connector may be inserted therein allowing the electrical contacts of the connector to interface with the receptacle-side electrical contacts. The receptacle shield is placed in the back of the receptacle, and is composed of an Electro-Magnetic Interference barrier material. In one embodiment, the receptacle shield is configured to interface with an EMI barrier of the connector, and includes separate slots through which electrical connections may pass.

This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Embodiments described herein relate to an electrical connector that has reduced electro-magnetic interference (EMI). The electrical connector may be mechanically configured to mate with an appropriate receptacle. The receptacle may be positioned on a host machine, or any other external computer, machine or device. When the electrical connector mechanically mates with an appropriate receptacle, at least some of the electrical contacts of the electrical connector make electrical contact with at least some of the electrical contacts of the corresponding receptacle. While not limited to this application, this connector is well suited for use in an active optical cable where the connector described herein is the external interface, but the actual data transmission is over a pair of optical fibers.

Figure 1A:
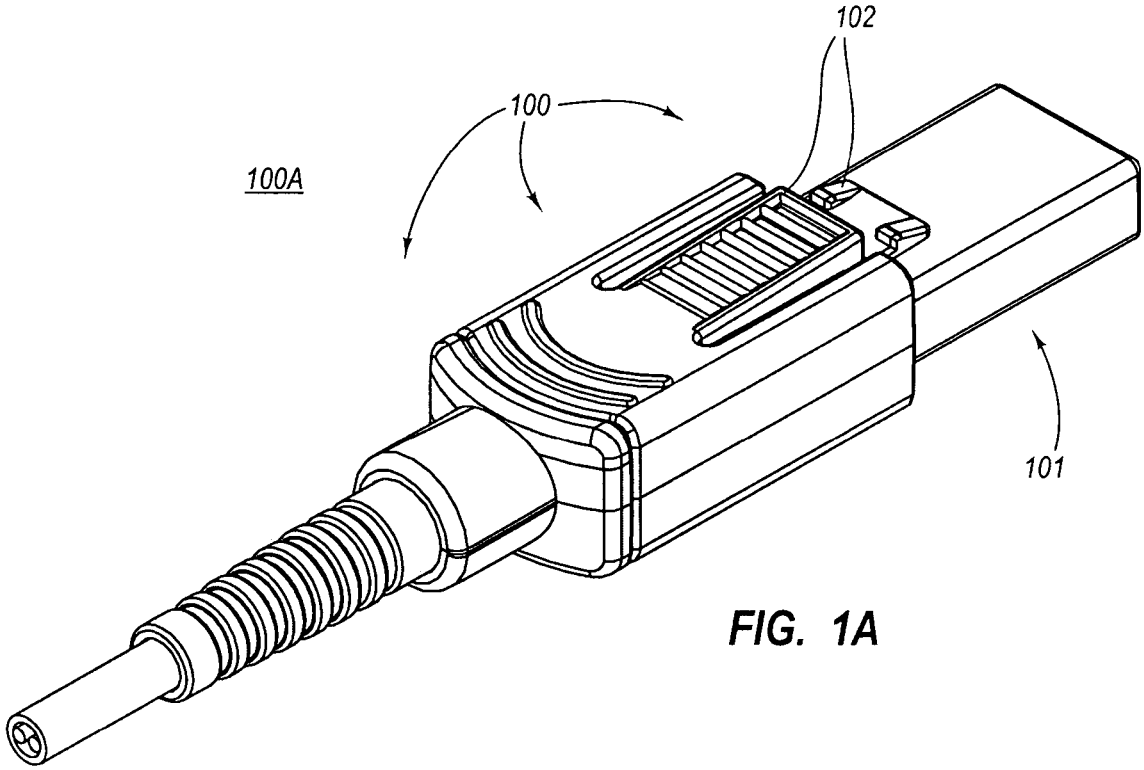
FIG. 1A illustrates a top rear perspective view of an electrical connector representing one embodiment of a connector.
Figure 1B:
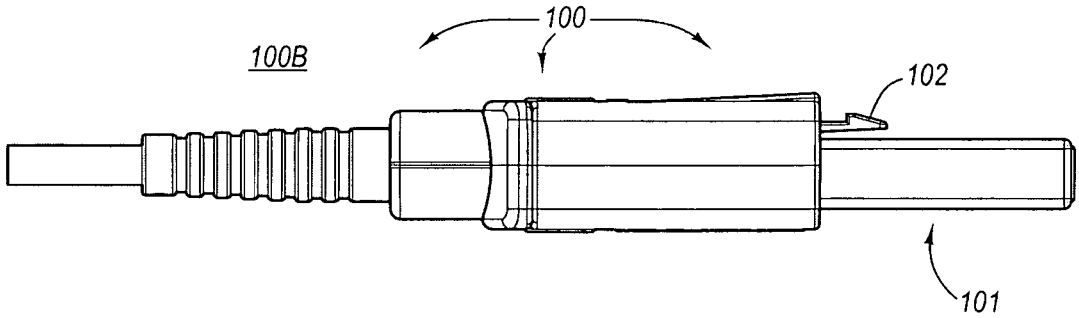
FIG. 1B illustrates a side view of the electrical connector of FIG. 1A.
Figure 1C:
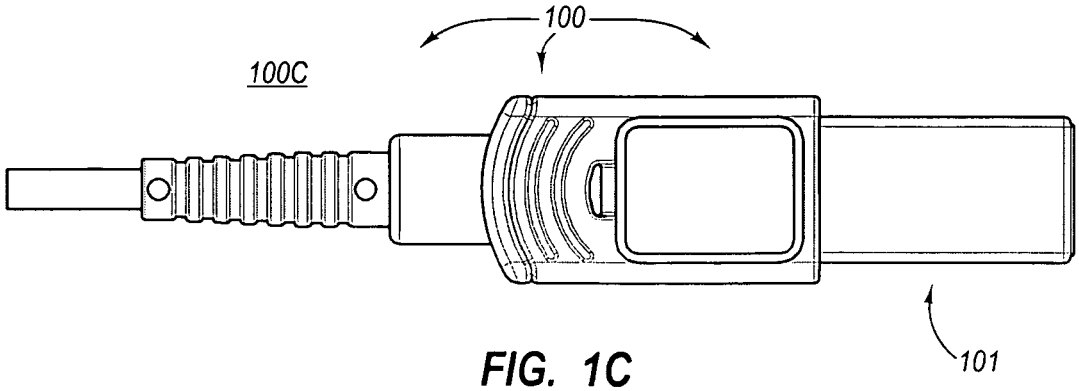
FIG. 1C illustrates a bottom view of the electrical connector of FIG. 1A.

FIGS. 1A, 1B and 1C illustrate a respective top rear perspective view 100A, side view 100B, and bottom view 100C of an electrical connector 100 representing one embodiment of a connector described herein. The connector 100 includes an insertion portion 101 that may be inserted into a receptacle, whereupon a latch 102 may mechanically engage with the receptacle to lock the connector 100 into place within the receptacle until the next time the latch 102 is disengaged. The latch 102 engages with the receptacle by simply pushing the insertion portion 101 into the receptacle, causing the latch 102 to depress downwards as the latch 102 engages the receptacle. The structure of the receptacle permits the latch 102 to spring back up into a mechanically locked position within the receptacle once the insertion portion 101 of the connector 100 is fully inserted into the receptacle. The latch 102 is disengaged from the receptacle by pressing downward on the latch 102, allowing the latch 102 to once again move freely out of the receptacle.

In this description, "front side" with respect to a connector means the electrical interface side of the connector closer to the insertion portion, while "rear side" means the side of the connector closer to the cable. "Top side" means the side of the connector that includes the latch, whereas "bottom side" means the side of the connector opposite the latch. This terminology will be consistent throughout this description when referring to a connector or a view of a connector, even if other components (such as a host receptacle and/or adaptors) appear in the view.

First, a detailed construction of the connector 100 will be described with respect to FIGS. 2A through 13D. Then, a variation in methods for terminating an optical fiber in an active optical cable implementation will be described. Third, the structure of the connector interfacing with a host receptacle will be described with respect to FIGS. 14A through 18. Fourth, the structure of the connector interfacing with an SFP adaptor will be described with respect to FIGS. 19 and 20. Finally, the structure of the connector interfacing with an XFP adaptor will be described with respect to FIGS. 21 and 22.

Connector Design

First, the connector structure will be described. In describing particular connectors, it will be understood by those of ordinary skill in the art after having read this description, that the principles of the present invention may be applied broadly to reduce EMI in any variety of electrical connectors. Accordingly, the detailed description of a particular connector embodiment should not be construed as being limiting of the broader principles of the present invention. Rather, the connector embodiment described herein should be considered as being illustrative only.

Figure 2A:
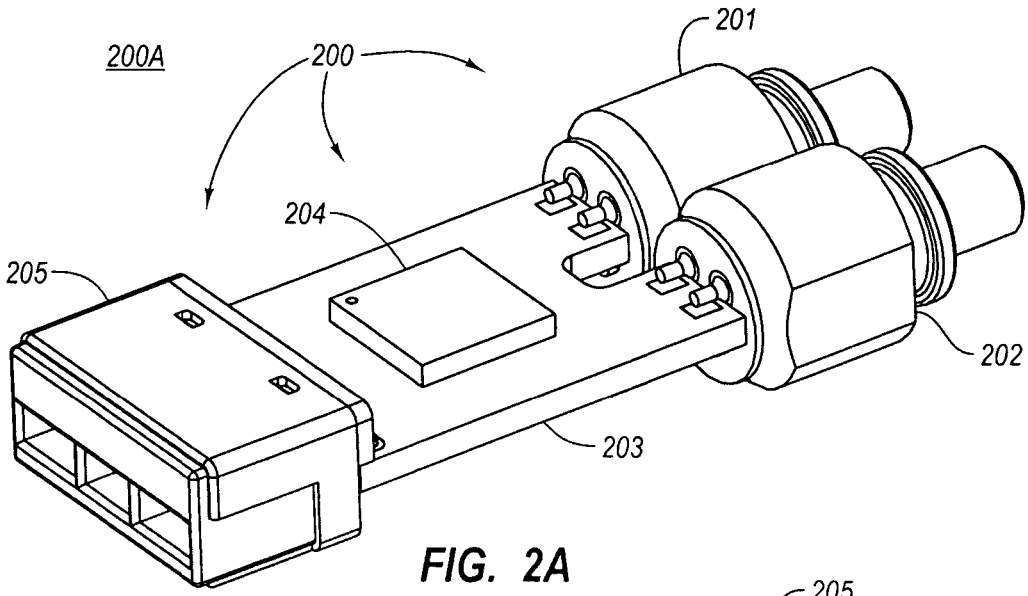
FIG. 2A illustrates a top front perspective view of several internal components of the connector of FIG. 1A.
Figure 2B:
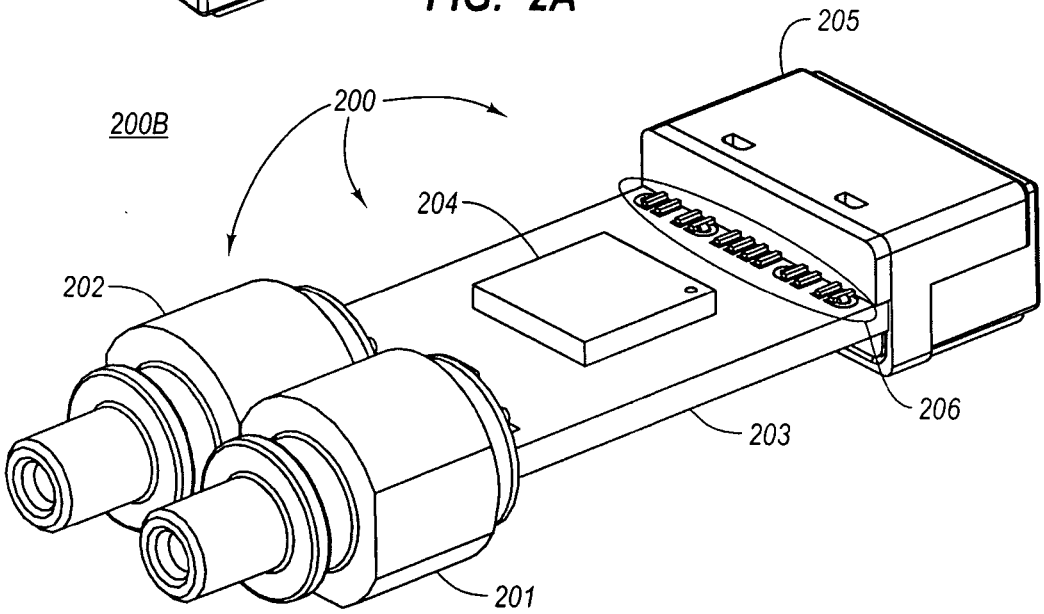
FIG. 2B illustrates a top rear perspective view of the internal components of FIG. 2A.

FIG. 2A illustrates a top front perspective view 200A of several internal components 200 of an active optical cable utilizing the present electrical connector. FIGS. 2B, 2C, 2D and 2E respectively illustrate a corresponding top rear perspective view 200B, side view 200C, front view 200D, and bottom view 200E of internal components 200 of the electrical connector 100 of FIG. 1. At this stage of the construction, the optical fibers are not yet shown. Only portions of the connector itself are shown.

The internal components 200 include a printed circuit board 203 having mounted thereon an integrated circuit 204 which includes thereon electrical processing circuitry. The integrated circuit 204 may have thereon any circuit advantageous or useful in converting electrical signals into optical signals and vice-versa. For instance, the integrated circuit 204 may include a laser driver, post amplifier, limiting amplifier, trans-impendence amplifier, controller, or any other desirable circuitry. The printed circuit board 203 communicates electrical signals to a Transmit Optical Sub-Assembly (TOSA) 201, which will eventually operate to convert such electrical signals into an optical transmit signal that will be transmitted into a transmit optical fiber (not yet shown in FIGS. 2A through 2E, but shown in some subsequent figures). A Receive Optical Sub-Assembly (ROSA) 202 will eventually operate to convert electrical signals received from a receive optical fiber (not yet shown) into electrical signals. The printed circuit board 203 communicates such electrical signals to the integrated circuit 204. The printed circuit board 203 also communicates electrical signals to and from electrical contacts 206 in electrical interface assembly 205. Such electrical contacts 206 will mechanically and electrically interface with the receptacle when the connector is plugged into the receptacle.

The principles of the present invention are not limited to the use of a connector that communicates over much of its length using an optical medium. The communication may instead be accomplished via electrical conductor means, such as an electrical cable of sufficient bandwidth for a desired data rate. In this case, however, TOSAs and ROSAs would not be needed, and instead appropriate electrical transmitters and receivers may be connected to the connector board 203. The principles of the present invention are also not limited to the use of an integrated circuit on a connector printed circuit board, but contemplate usage in embodiments in which a single die package is used both as the structural support for the electrical circuitry as well as structural support for the TOSA and ROSA.

Figure 2C:
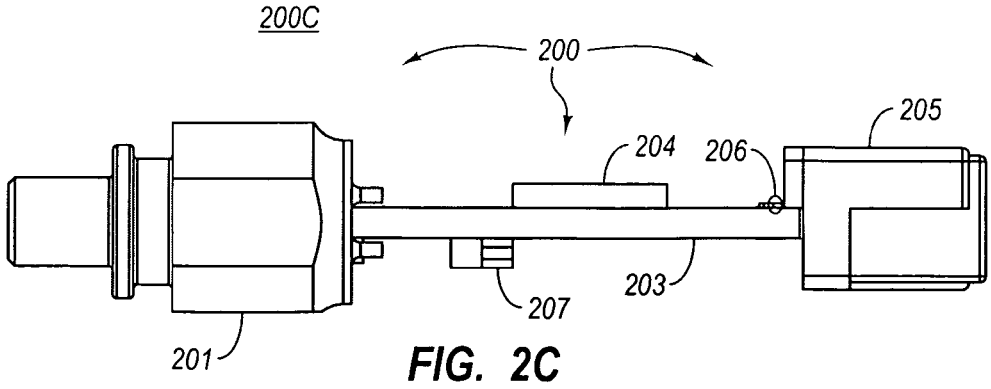
FIG. 2C illustrates a side view of the internal components of FIG. 2A.
Figure 2D:
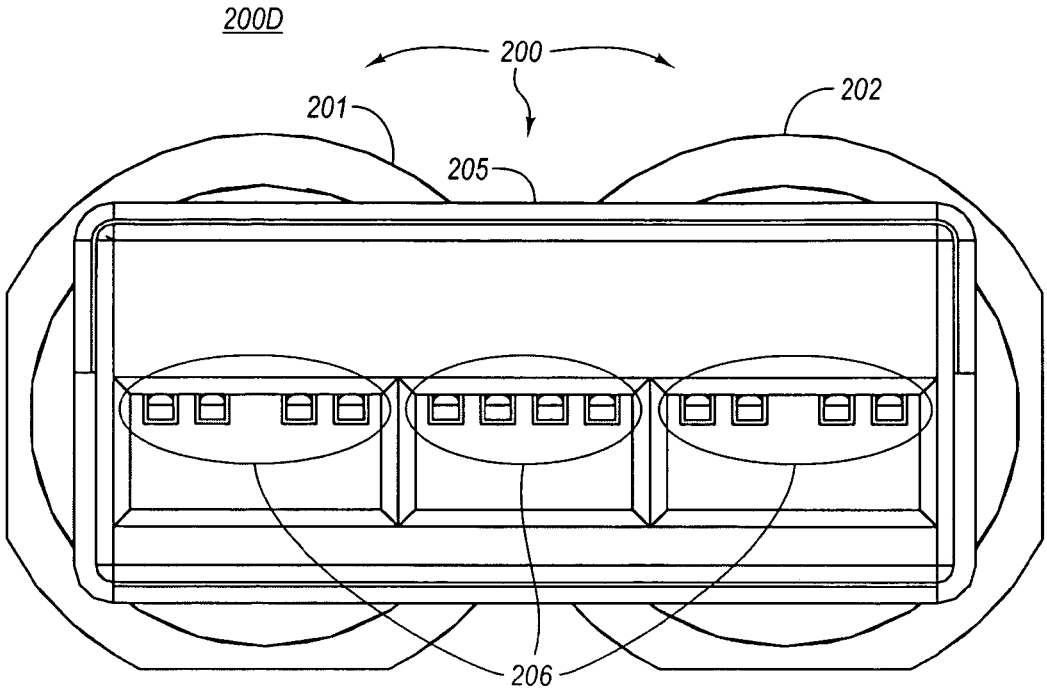
FIG. 2D illustrates a front view of the internal components of FIG. 2A.
Figure 2E:
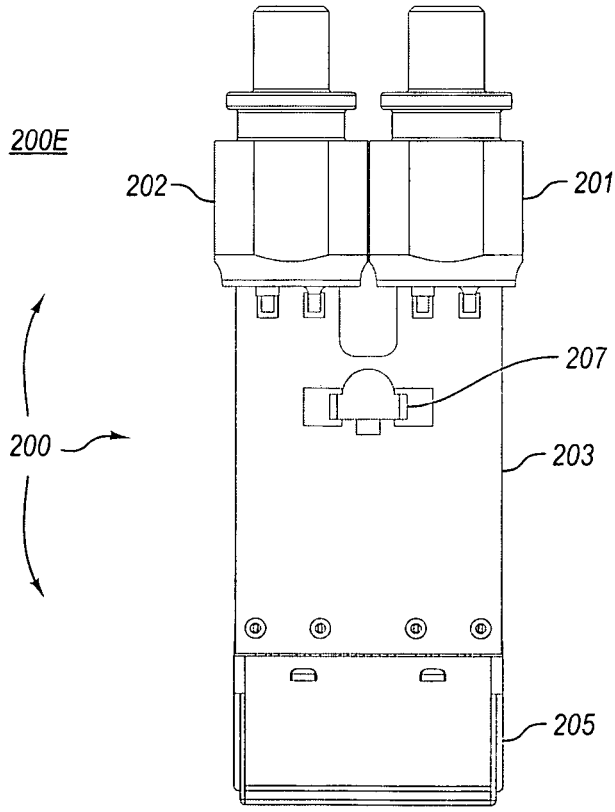
FIG. 2E illustrates a bottom view of the internal components of FIG. 2A.

In one embodiment, a Light Emitting Diode (LED) 207 is fixed on the bottom side of the printed circuit board 203 as can best be seen from FIGS. 2C and 2E. The LED 207 will be used as a light source to communicate status information to a user. Ultimately, as will be apparent from subsequent figures, the LED 207 will channel light through an optical light guide (described further below) so as to emit visible light external to the connector. By this mechanism, status information may be visually communicated to a user.

The construction of the electrical interface assembly 205 will be further described with respect to FIGS. 3A through 3E, which illustrate various components of the electrical interface assembly 205 in various views and stages of construction. The electrical interface assembly 205 may be manufactured in advance of the assembly of the connector 100.

Figure 3A:
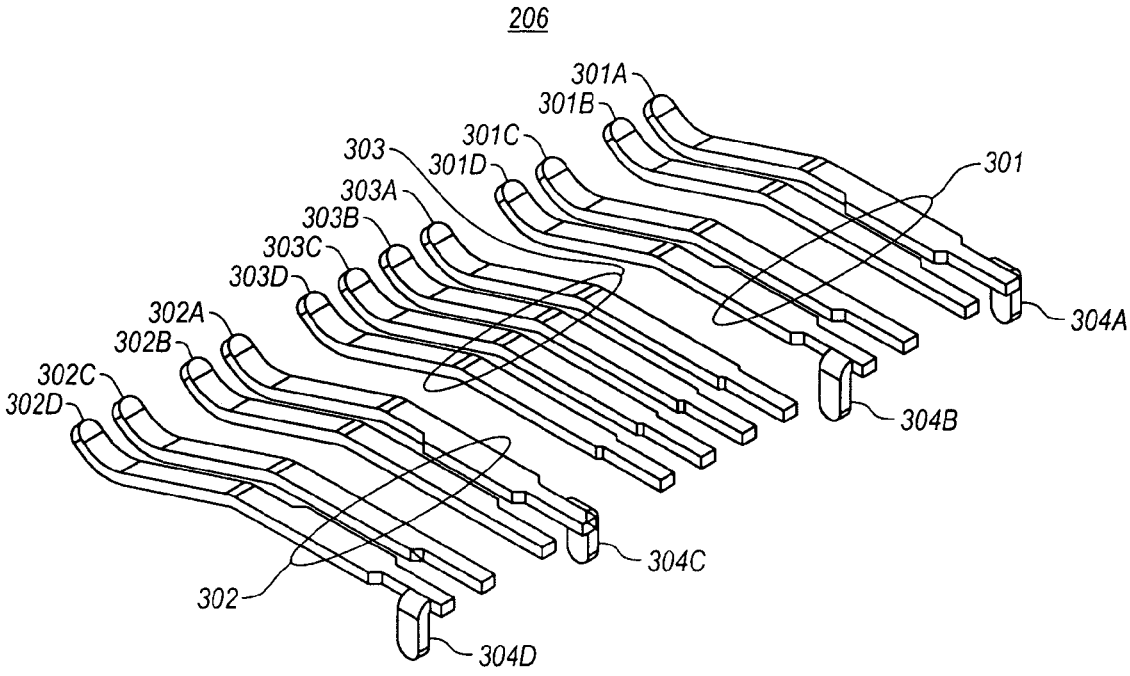
FIG. 3A illustrates an electrical interface assembly that begins with the connector electrical contacts.

Referring to FIG. 3A, electrical contacts 206 are segmented in several groups. For instance, the electrical contacts includes contact group 301 including four contacts total (contacts 301A, 301B, 301C and 301D), contact group 302 including four contacts total (contacts 302A, 302B, 302C and 302D), and contact group 303 including four contacts total (contacts 303A, 303B, 303C and 303D). In subsequent figures, individual contacts may sometimes not be labeled in order to avoid unnecessarily complicating the figures. However, contact groups may more often be labeled.

Each contact group 301 through 303 is separated from other groups by a particular distance. For instance, there is a larger gap between contacts 301D and 303A, and between contacts 303D and 302A. Although the principles of the present invention are not limited to the grouping of such electrical contacts, this grouping can result in reduced EMI emissions of the connector as will be explained further below. Furthermore, although the connector is shown as including 12 contacts, divided into three groups of four, the principles of the present invention are not limited to a connector with a particular number of contacts, or to a connector having a particular grouping of contacts.

In one embodiment, the contact group 301 may be used for communicating differential electrical transmit signals (sometimes referred to in the art as TX+ and TX− signals) and also include two ground signals for improved signal quality. For instance, contacts 301A and 301D may be ground contacts, whereas contacts 301B and 301C may be TX+ and TX− contacts actually carrying the differential electrical transmit signal during operation. By controlling the distance between the differential transmit contacts 301B and 301C, and between each differential transmit contact and the neighboring ground contact 301A or 301D, the common mode impedance and differential mode impedance of the electrical transmit signal may be more closely controlled.

The contact group 302 may be used for communicating differential electrical receive signals (sometimes referred to as RX+ and RX− signals) and also include two ground signals for improved signal quality. For instance, contacts 302A and 302D may be ground contacts, whereas contacts 302B and 302C may be RX+ and RX− contacts actually carrying the differential electrical receive signal during operation. Once again, by controlling the distance between the differential receive contacts 302B and 302C, and between each differential receive contact and the neighboring ground contact 302A or 302D, the common mode impedance and differential mode impedance of the electrical receive signal may also more closely controlled. Such common mode and differential mode impedance control serves to reduce signal degradation contributed by the contacts, which is especially important at high data rates.

Note that each of the ground contacts 301A, 301D, 302A and 302D have a respective post 304A, 304B, 304C and 304D. The posts may be inserted into existing ground holes in the printed circuit board 203, to allow for secure grounding of the ground contacts. Furthermore, this allows for a more secure mechanical connection between the electrical interface assembly 205 and the printed circuit board 203, thereby perhaps improving reliability. The securing of the ground contact posts into corresponding ground holes of the printed circuit board might best be seen in FIG. 2B.

The contact group 303 may have contacts that serve purposes other than actually carrying the high speed electrical signals. For instance, the contacts 303 may be used to power the integrated circuit 204 and LED 207, may carry far-side power for providing power through the cable itself ((if there is an electrical conductor also in the cable), may be used for a low speed serial interface (one wire or perhaps two wire), or any other desired purpose. One of the contacts in the contact group 303 might be used to accomplish a connector presence detection function. For example, one of the contacts may be grounded, whereas the corresponding contact in the receptacle is pulled high. If the connector is plugged into the receptacle, the receptacle contact will then be drawn low, allowing the receptacle, and any connected host to identify that the connector is present.

That said, the specific contact configuration is only an example, and should not be read as limiting the broader scope of the principles of the present invention. The principles of the present invention are not limited to this particular construction whatsoever. Neither are they limited to use in a connector that is bi-directional. Rather, the principles may be applied to a connector that serves only as a receiver, or only as a transmitter. Furthermore, the principles of the present invention may apply regardless of the number of transmit channels (zero or more), and regardless of the number or receive channels (zero or more).

Figure 3B:
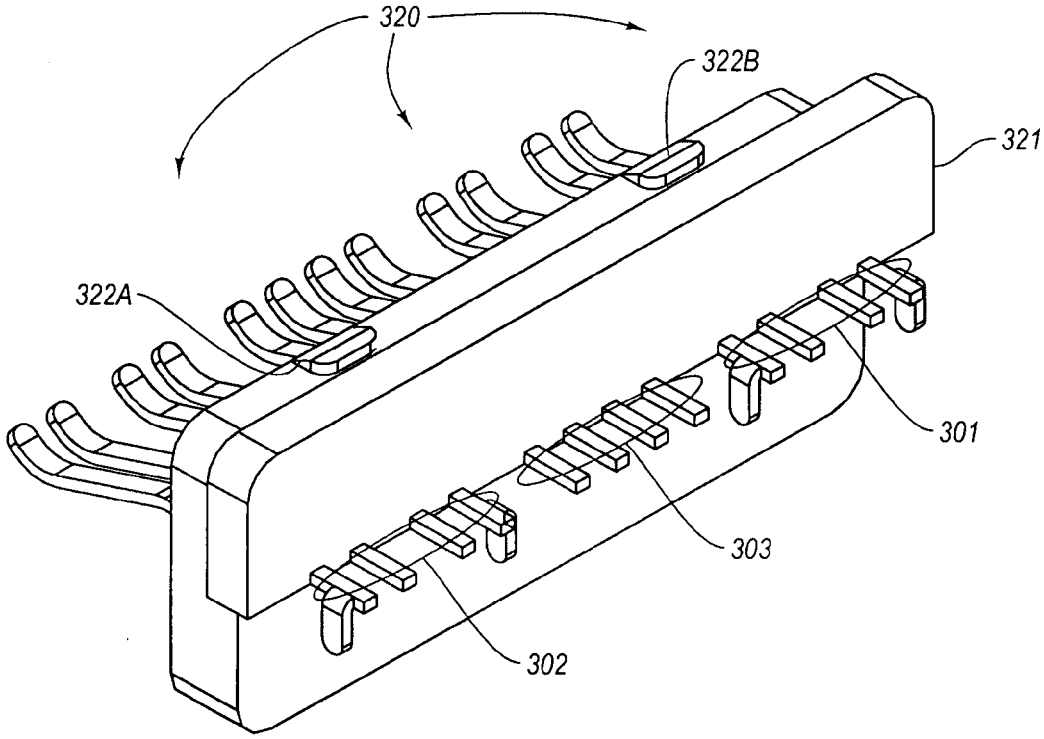
FIG. 3B illustrates a top rear perspective view of the electrical interface assembly with an overmolded body added to the components of FIG. 3A.

FIG. 3B illustrates a top rear perspective view of components 320 of the electrical interface assembly 205. The components 320 include the contact groups 301, 302 and 303 overmolded by a body 321. The body may be composed of a structurally rigid, but electrically insulative material, such as plastic. This allows the contact groups 301, 302 and 303 to be structurally supported, while preventing the contacts from shorting to each other.

Figure 3C:
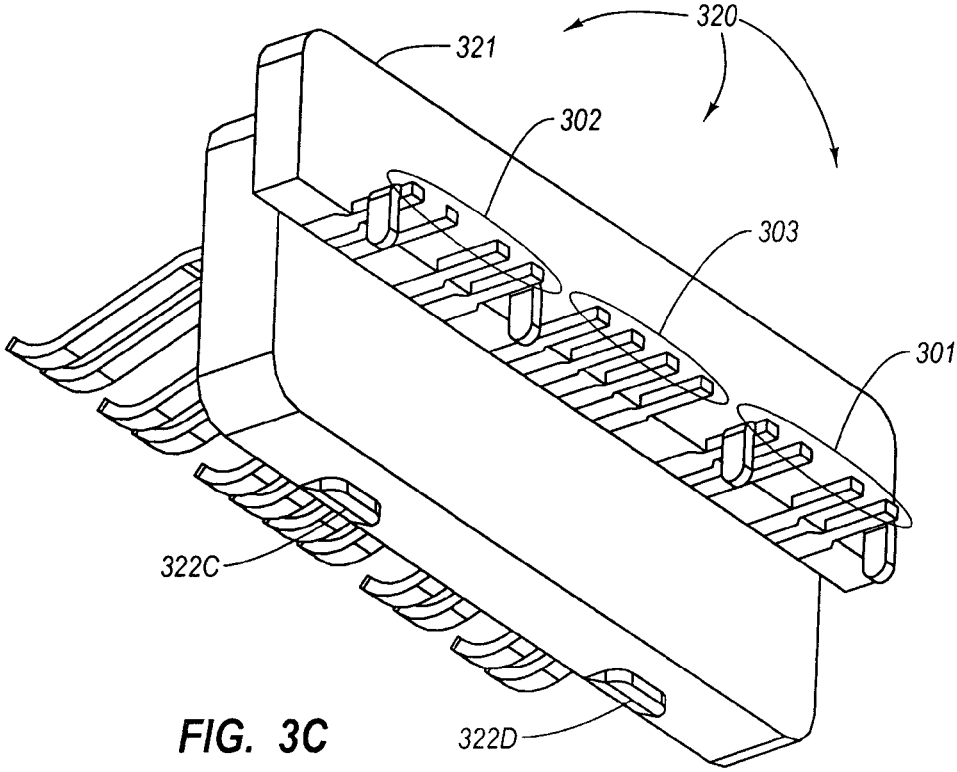
FIG. 3C illustrates a bottom rear perspective view of the electrical interface assembly of FIG. 3B.

FIG. 3C illustrates the components 320 from a bottom rear perspective. In order to control the impedance of the various contacts, the contacts may have various forms within the body 321. The body 321 contains various sloped protrusions 322A through 322D to allow for body 321 to be mechanically interlocked with the housing 341 as will be described with respect to FIGS. 3D through 3G.

Figure 3D:
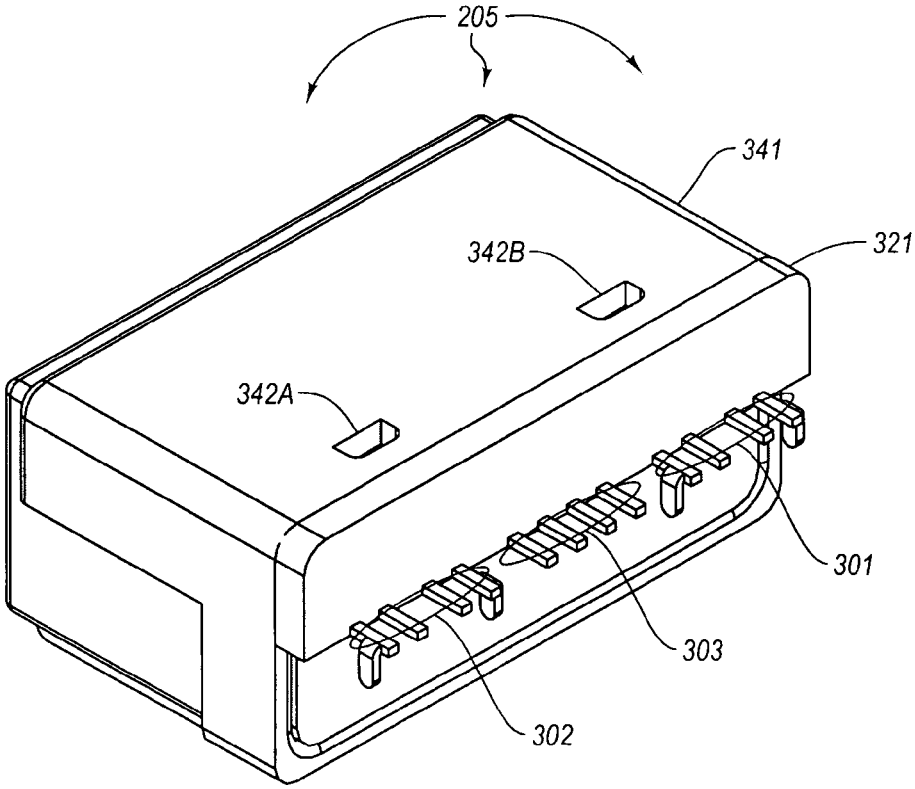
FIG. 3D illustrates a top rear perspective view of the electrical interface assembly, which further adds a housing to the components of FIGS. 3B and 3C.
Figure 3E:
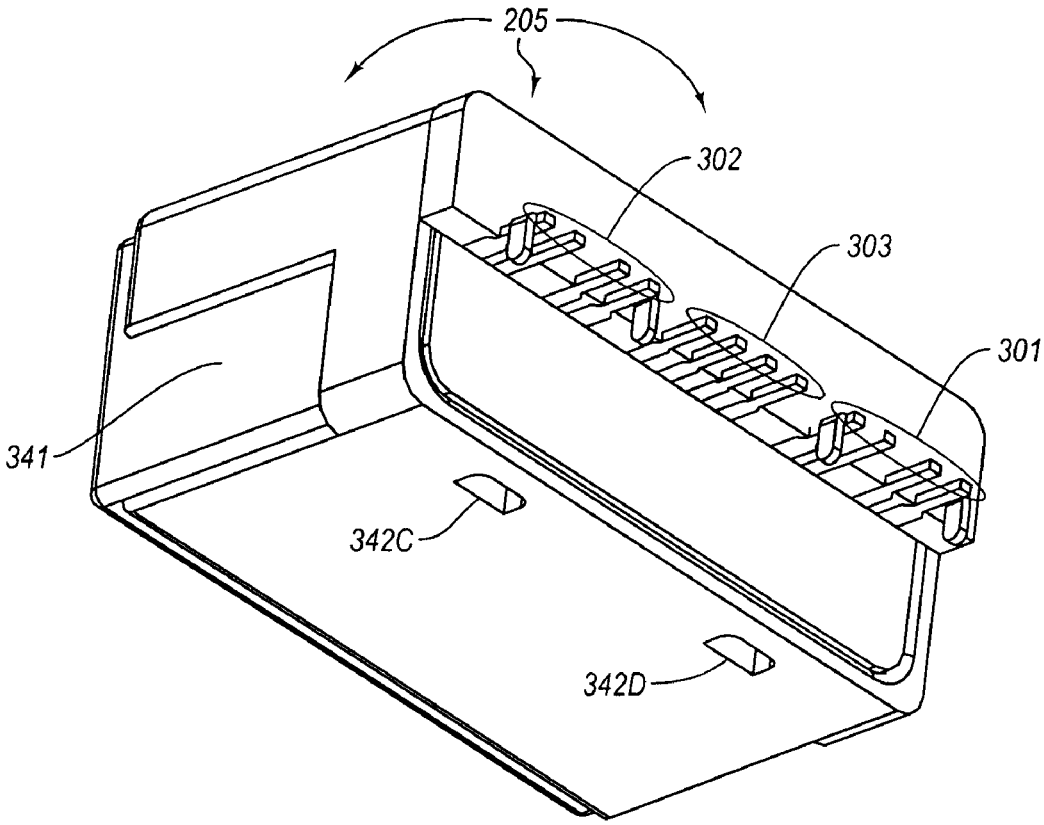
FIG. 3E illustrates a bottom rear perspective view of the electrical interface assembly of FIG. 3D.

FIGS. 3D and 3E illustrate a respective top rear perspective view, and a bottom rear perspective view of the electrical interface assembly 205, which adds a housing 341 to the components 320 of FIGS. 3B and 3C. The housing 341 may be slid onto the components 320 of FIGS. 3B and 3C from the front, such that the sloped protrusions 322A through 322D of the body 321 engage with the holes 342A through 342D, respectively, of the housing 341. The housing 341 may be composed of a material that serves as an electrical insulator, such as plastic.

Figure 3F:
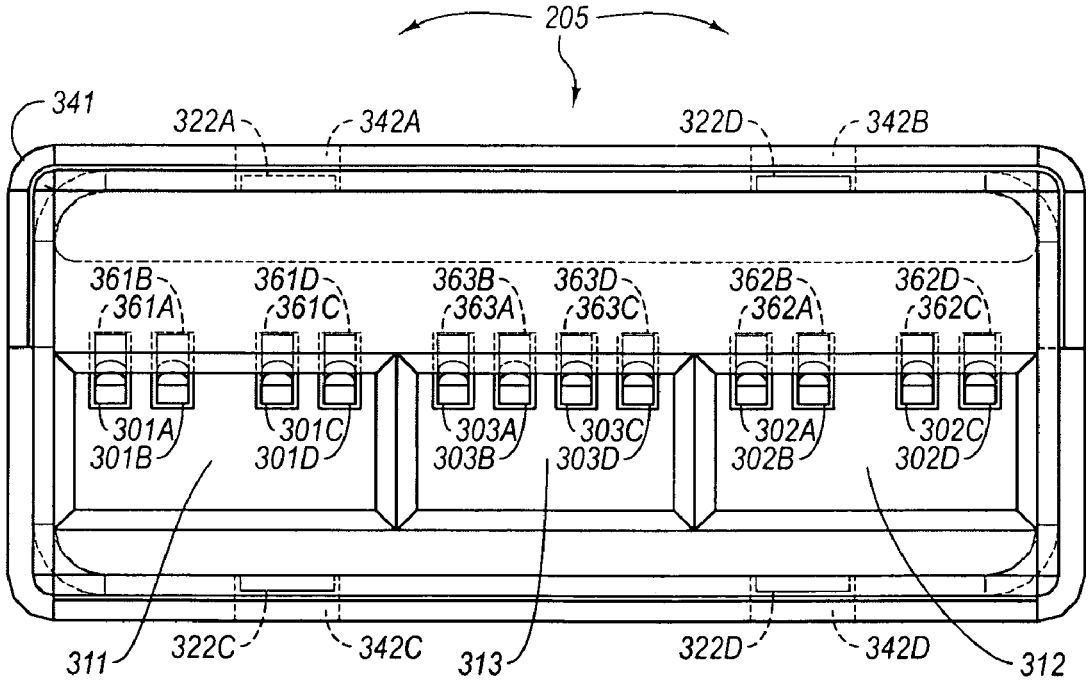
FIG. 3F illustrates a front view of the electrical interface assembly of FIG. 3D.
Figure 3G:
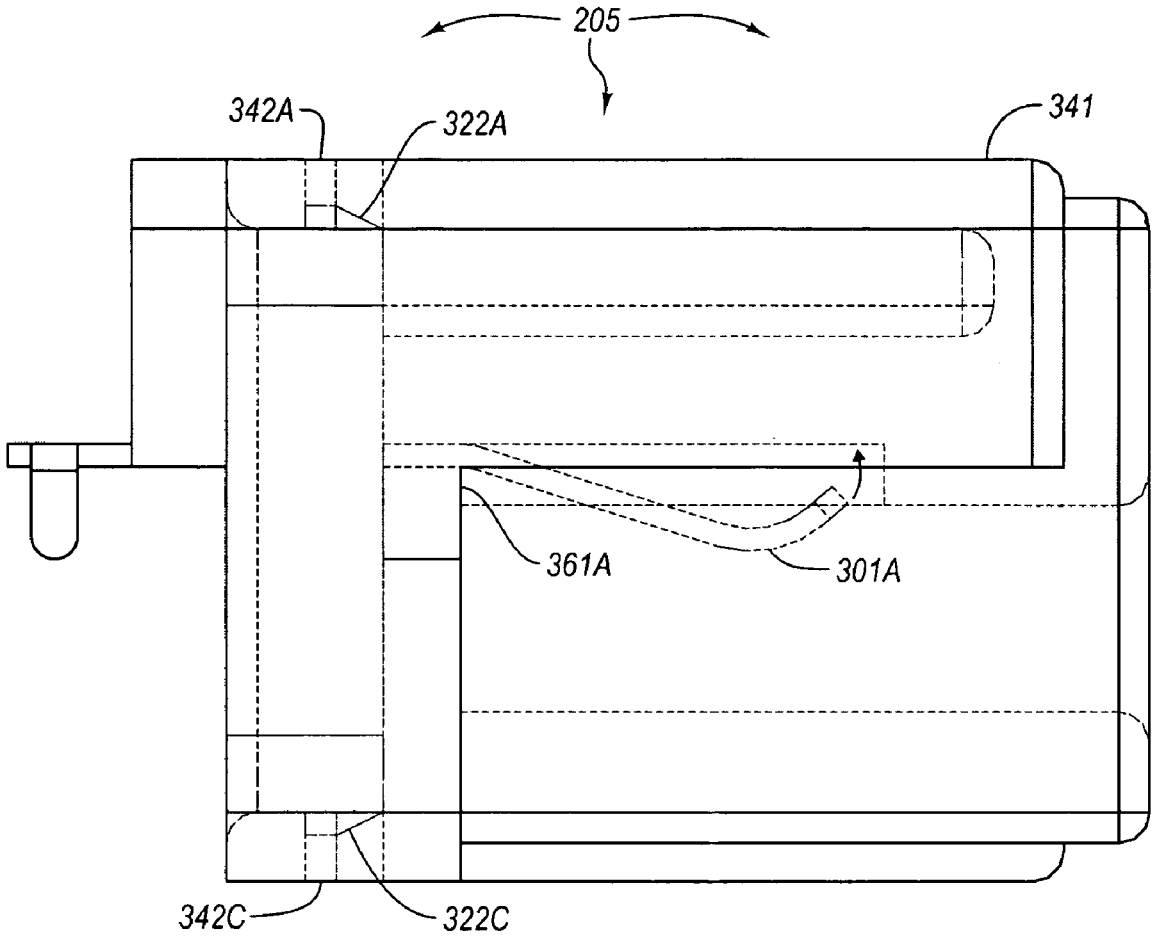
FIG. 3G illustrates a side view of the electrical interface assembly of FIG. 3D.
Figure 4A:
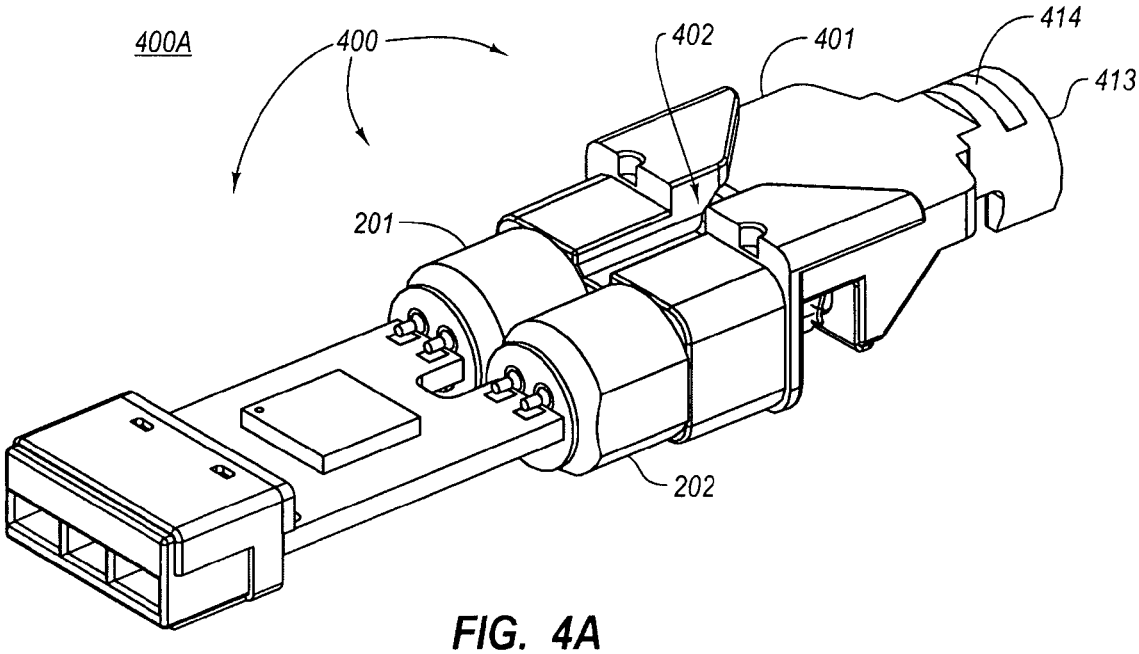
FIG. 4A illustrates a top front perspective view of the connector in which a plug chassis is added.
Figure 4B:
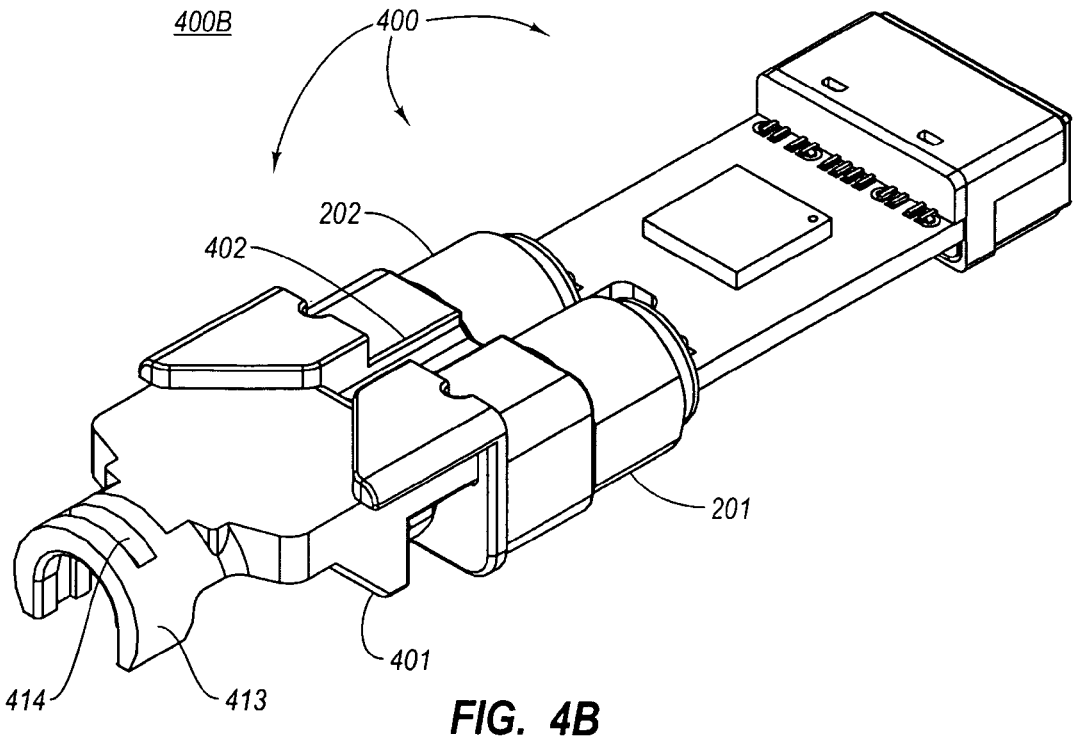
FIG. 4B illustrates a top rear perspective view of the connector of FIG. 4A.
Figure 4C:
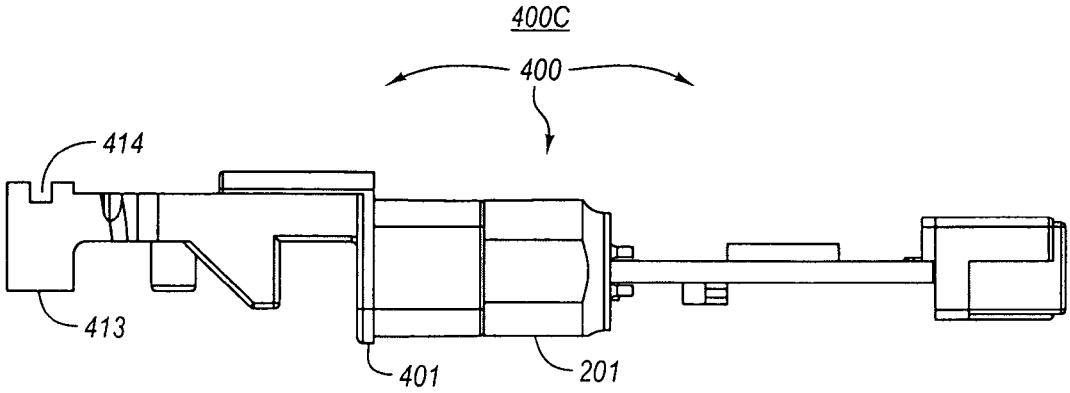
FIG. 4C illustrates a side view of the connector of FIG. 4A.
Figure 4D:
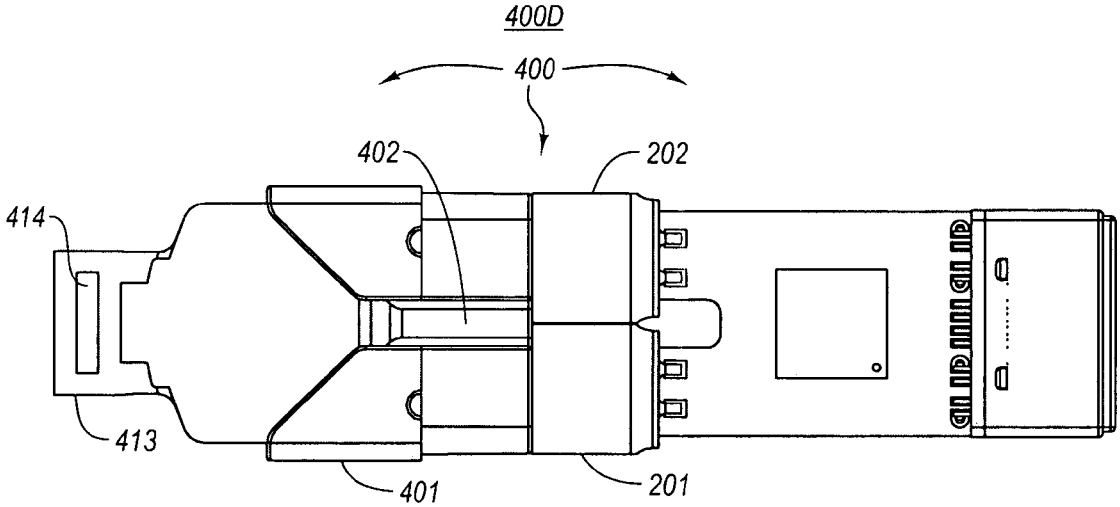
FIG. 4D illustrates a top view of the connector of FIG. 4A.
Figure 4E:
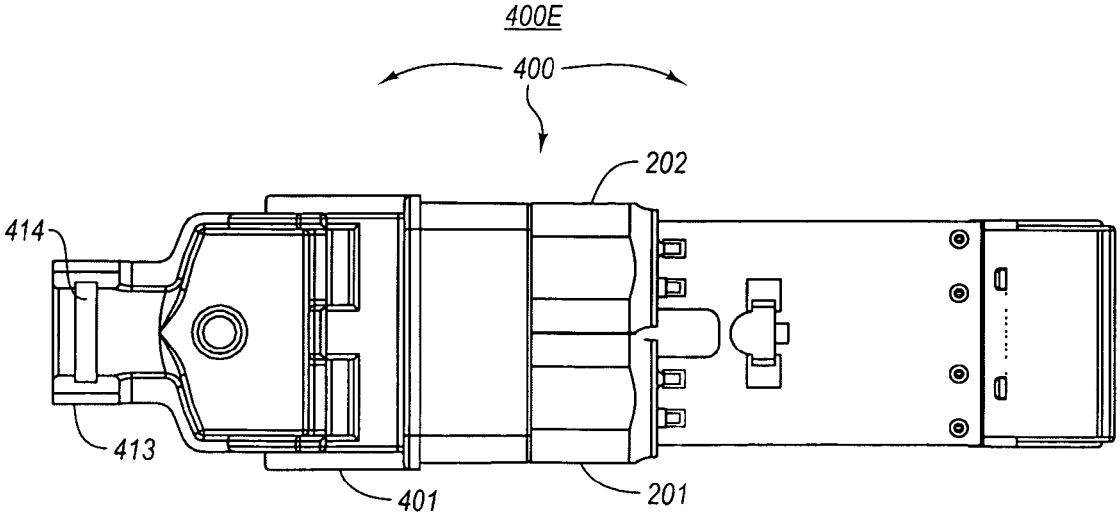
FIG. 4E illustrates a bottom view of the connector of FIG. 4A.
Figure 4F:
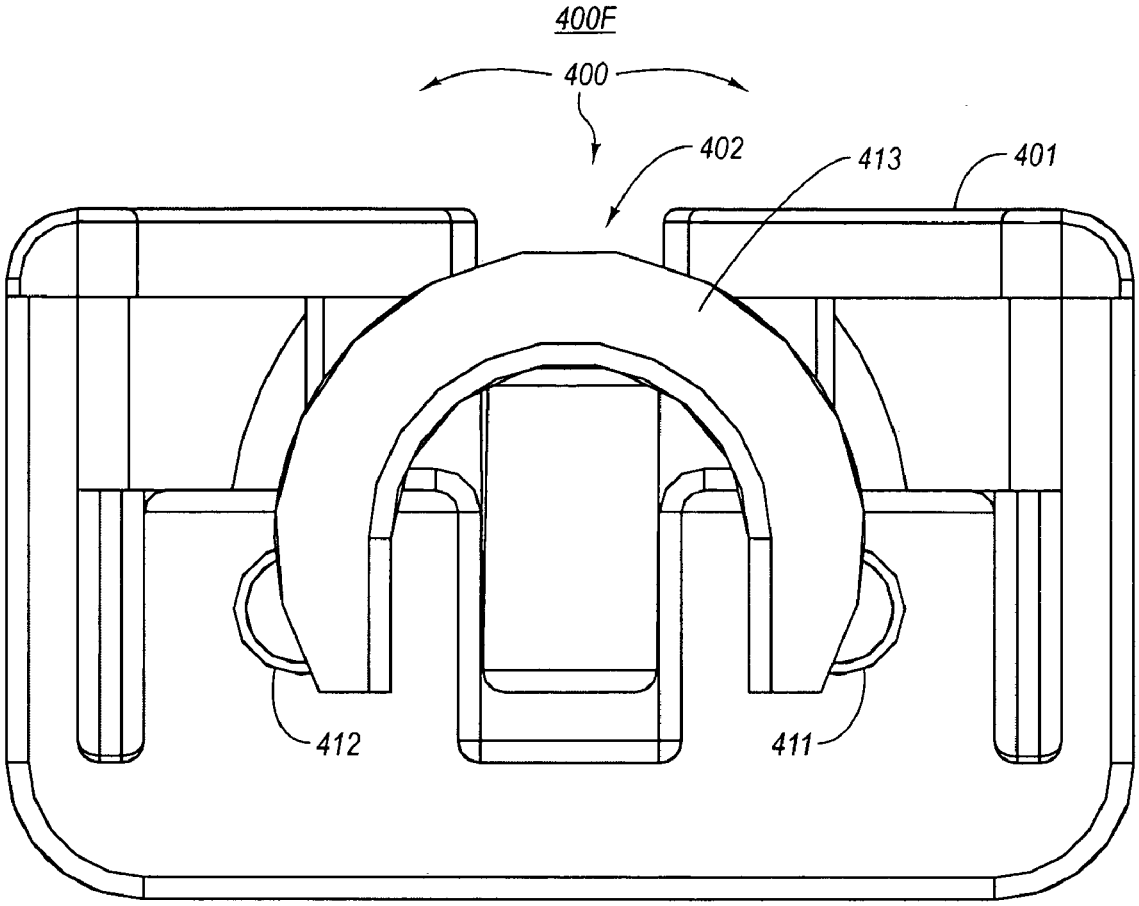
FIG. 4F illustrates a back view of the connector of FIG. 4A.

FIGS. 3F and 3G illustrate a respective front view, and side view of the electrical interface assembly 205. In this case however, the housing 341 is shown in transparent form. As apparent from FIG. 3F, each of the electrical contacts 301A through 301D, 302A through 302D, and 303A through 303D extend through the body 321, and through a respective hole 361A through 361D, 362A through 362D, and 363A through 363D, of the housing. As apparent from FIG. 3G, each of the contacts (e.g., electrical contact 301A) has some clearance to move upwards when contacting an electrical connector of the receptacle, without making contact with the housing 341.

As previously mentioned, the assembled electrical interface assembly 205 may then be attached to the printed circuit board 203 to formulate the components 200 of FIGS. 2A through 2E. The electrical interface assembly 205 itself, does not act as an EMI barrier, but will be one area of EMI barrier discontinuity in the overall EMI barrier.

An EMI barrier "discontinuity" or "opening" with respect to an EMI barrier is an area that does not serve to block EMI emissions therethrough. For example, plastic, such as body 321 or housing 341 will not block EMI emissions, whereas conductive material, such as metal, will. Generally speaking, an EMI discontinuity acts as a high pass filter for EMI emissions, where the cutoff frequency will depend on the effective area of the EMI barrier opening. If an EMI barrier has multiple EMI barrier openings, the largest EMI barrier opening will generally control the cutoff frequency of the EMI barrier. Generally speaking, the smaller the maximum EMI barrier opening, the greater the cutoff frequency of the EMI barrier. For instance, EMI barriers with small EMI barrier openings will filter out EMI at higher frequencies than will EMI barriers with large EMI barrier openings.

FIGS. 4A through 4F illustrate a respective top front perspective view 400A, top rear perspective view 400B, side view 400C, top view 400D, bottom view 400E, and back view 400F, of components 400 of the connector 100. The components 400 of FIGS. 4A through 4F add to the components 200 of FIGS. 2A through 2E, by inserting the narrow cylindrical insert portion of the TOSA 201 into a hole 411 of a plug chassis 401, and by inserting the narrow cylindrical insert portion of the ROSA 202 into a hole 412 of the plug chassis 401. This mechanically couples the plug chassis 401 to the TOSA 201 and ROSA 202. At this stage, the plug chassis 401 might still be able to slide relative to the TOSA 201 and ROSA 202. However, in subsequent assembly steps, the plug chassis 401 may be secured. The plug chassis 401 has a channel region 402 into which a light guide may be situated while lying flush with the upper surface of the plug chassis 401. The plug chassis 401 also has other features whose function will become apparent from subsequent description including a cable insertion portion 413 having a slot 414 formed therein. In one embodiment, the plug chassis 401 serves as an EMI barrier at the back end of the connector. The plug chassis 401 may be a die cast mold, and may perhaps be metal, or a plastic infused with the metal, such as, for example, zinc or copper.

Figure 5A:
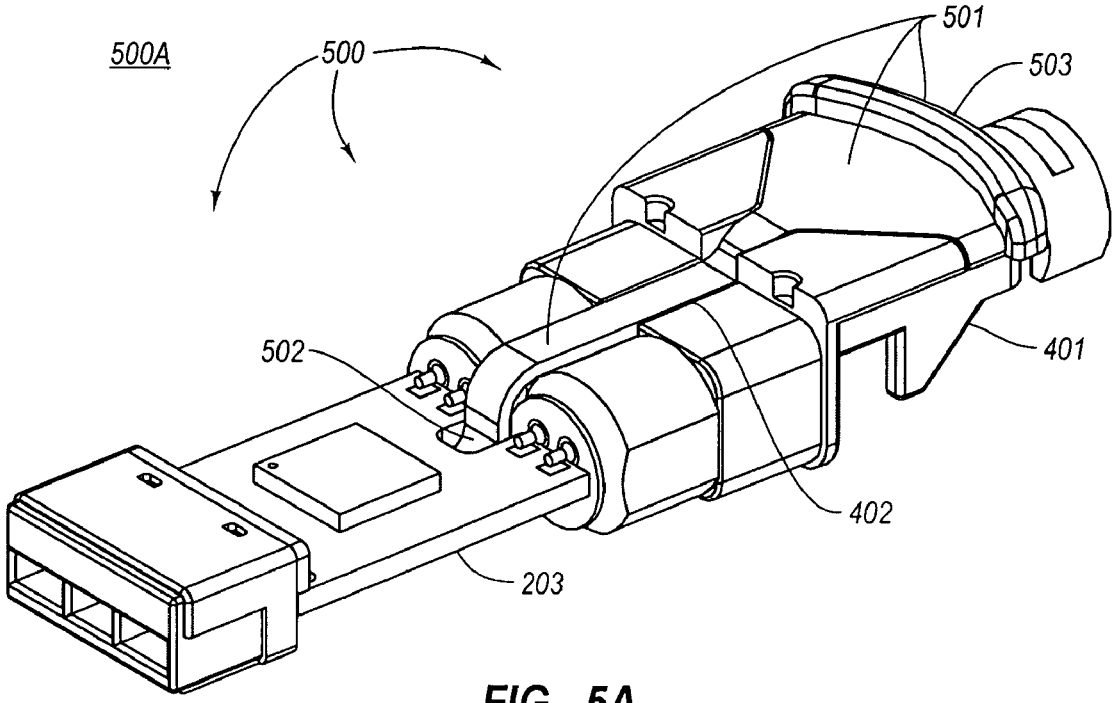
FIG. 5A illustrates a top front perspective view of the connector with an optical light guide added.
Figure 5B:
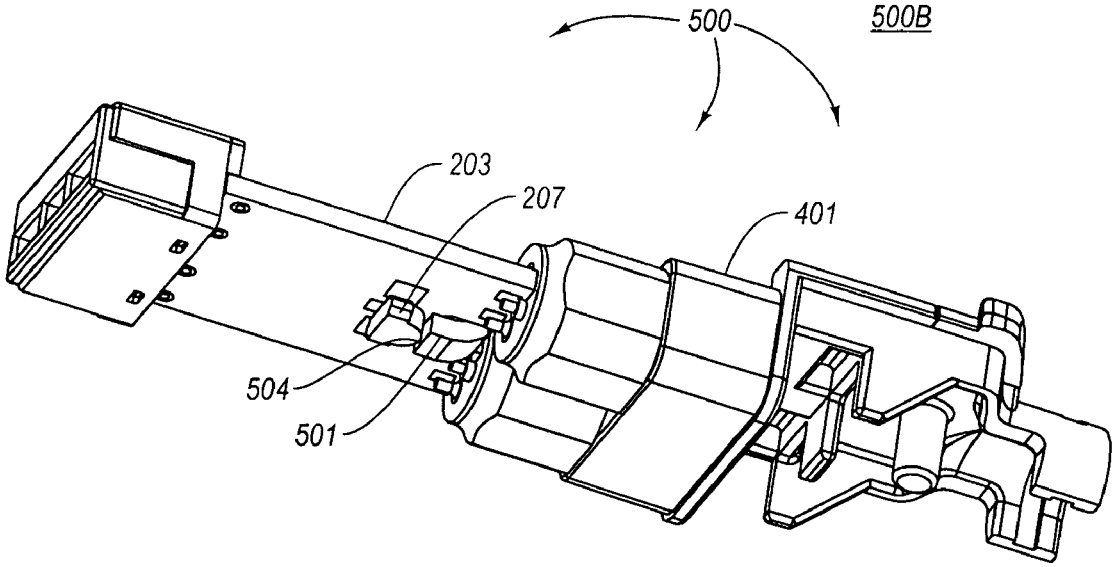
FIG. 5B illustrates a bottom front perspective view of the connector of FIG. 5A.

FIGS. 5A and 5B illustrate a respective top front perspective view 500A and bottom front perspective view 500B of components 500 of the connector 100. The components 500 of FIGS. 5A and 5B add to the components 400 of FIGS. 4A through 4F by adding an optical light guide 501. A portion 504 of the optical light guide 501 is passed through a hole 502 in the printed circuit board 203 to optically couple with the LED 207. The optical light guide 501 is situated in place by being placed into the channel 402 of the plug chassis 401. If light is emitted by the LED 207, at least some of that light passes through the optical light guide 501, and is emitted outside of the connector using external portion 503 of the optical light guide 501.

Figure 6A:
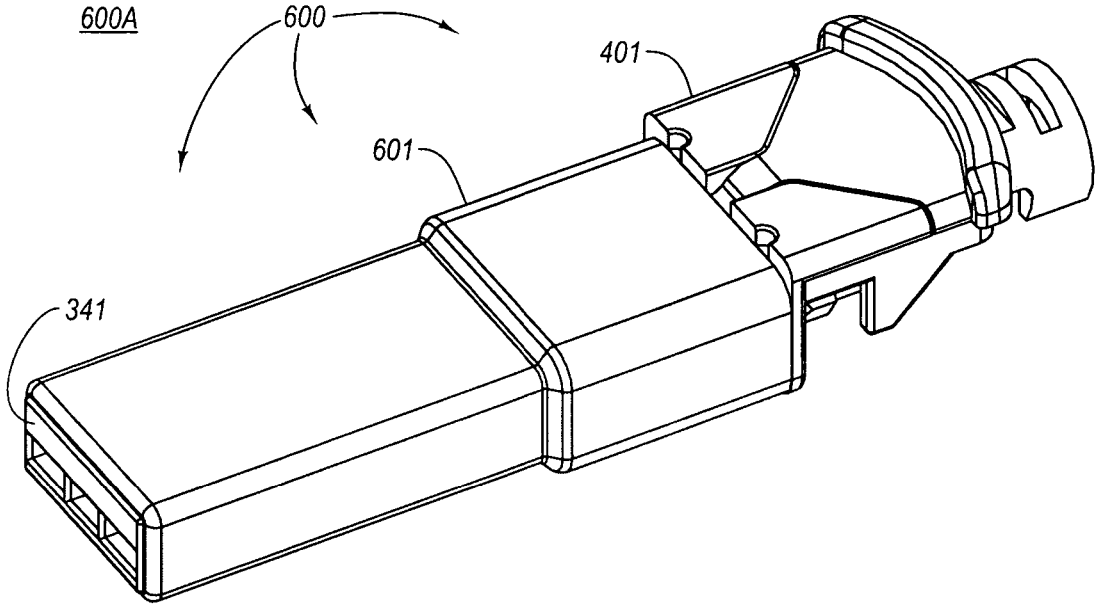
FIG. 6A illustrates a top front perspective view of the connector with an integrated EMI barrier sleeve added.
Figure 6B:
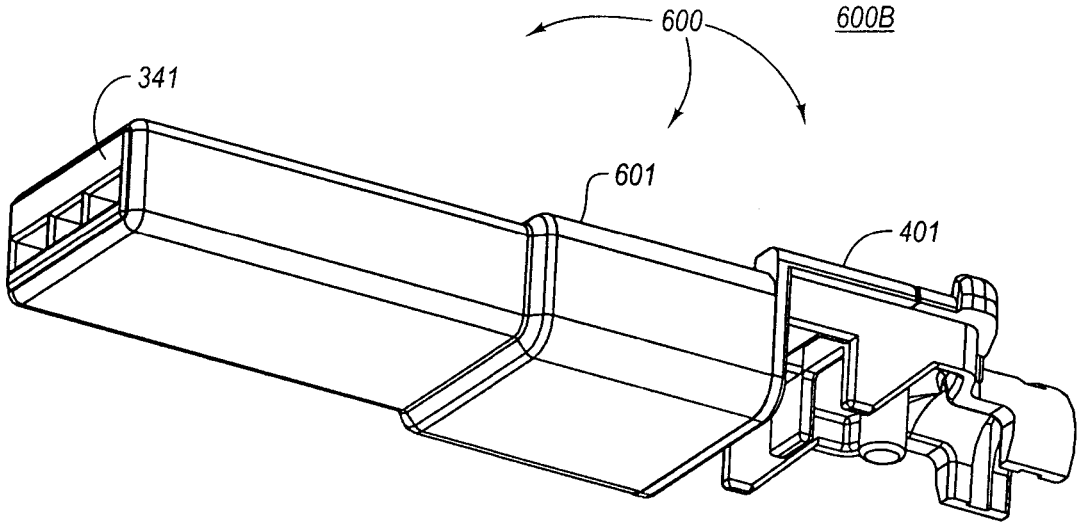
FIG. 6B illustrates a bottom front perspective view of the connector of FIG. 6A.

FIGS. 6A and 6B illustrate a respective top front perspective view 600A and bottom front perspective view 600B of components 600 of the connector 100. The components 600 of FIGS. 6A and 6B add to the components 500 of FIGS. 5A and 5B by sliding an integrated sleeve 601 over the front of the connector to thereby press fit with the plug chassis 401. This mechanically fixes the parts of the connector in place. The integrated sleeve 601 also serves as an EMI barrier. In one embodiment, the sleeve is composed of metal, but any other EMI barrier material will suffice. Accordingly, the sleeve, in combination with the plug chassis 401 serve as an EMI barrier for the connector, except for several EMI barrier openings, the most significant and largest being at the front end of the connector at portion 341. However, there are smaller EMI barrier openings at the holes 411 and 412 and the light guide channel 402 of the chassis 401. As will be described hereinafter, even more complete EMI protection is afforded when the connector is plugged into a receptacle. As will be described hereinafter, when the connector is plugged in, a receptacle-side socket shield positioned at the back of the receptacle provides EMI protection to the front of the connector. Thus, in this plugged-in state, the connector is encased by an EMI shield, except for a few smaller openings.

Specifically, the only holes (also referred to as EMI barrier openings) in the EMI barrier are 1) the front of the connector, 2) the small openings of the TOSA 201 and ROSA 202 through which the optical fibers and ferrules will pass, and 3) the small hole through which the optical light guide 501 passes to communicate light from inside the EMI barrier to outside the EMI barrier. As mentioned above, the EMI barrier is completed by the socket shield in the receptacle when the plug is inserted. All of these holes are quite small, and thus there will be little in the way of EMI signals permitted to passes to or from the connector, even at TOG data rates. This EMI barrier thus improves the signal quality of the high speed electrical signals, and other signals present within the connector. This also inhibits the high frequency signals generated within the connector from disturbing other equipment external to the connector.

Figure 7A:
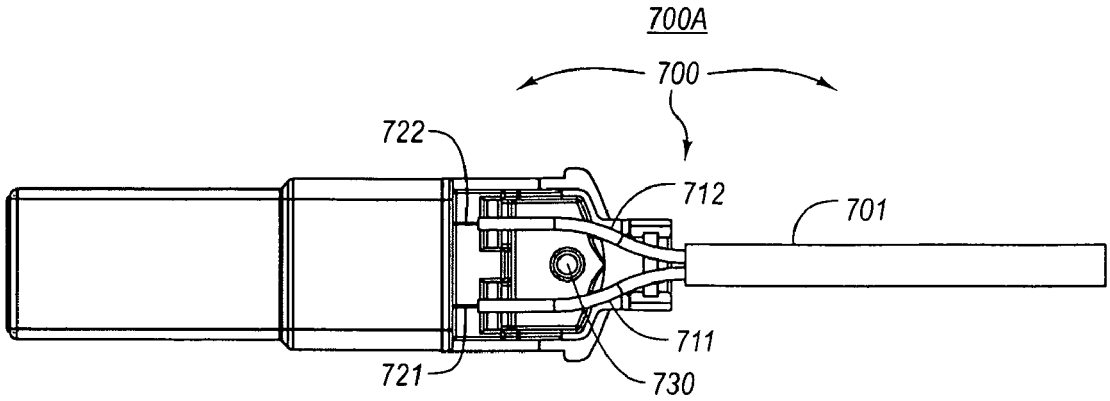
FIG. 7A illustrates a bottom view of the connector with the optical cable added.
Figure 7B:
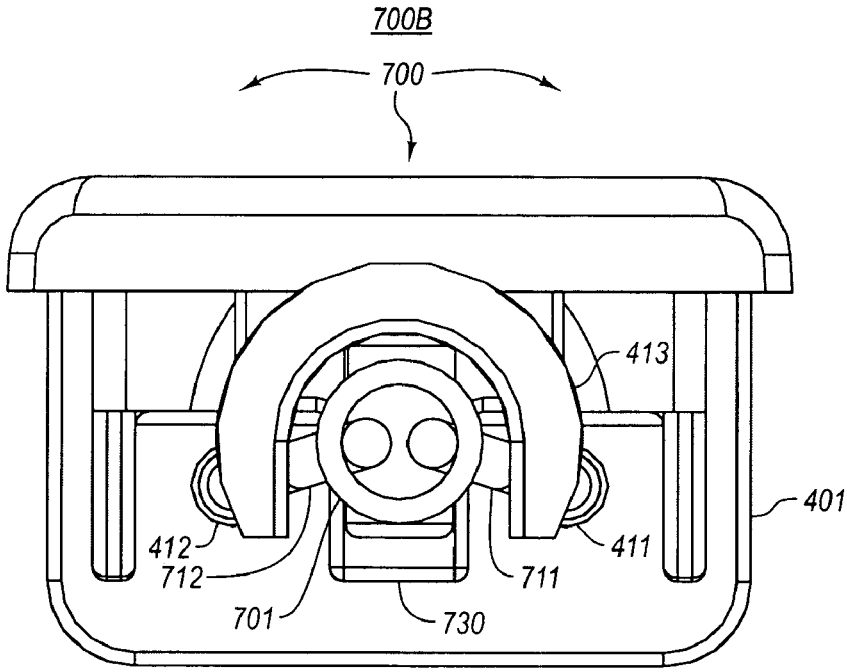
FIG. 7B illustrates a back view of the connector of FIG. 7A.
Figure 7C:
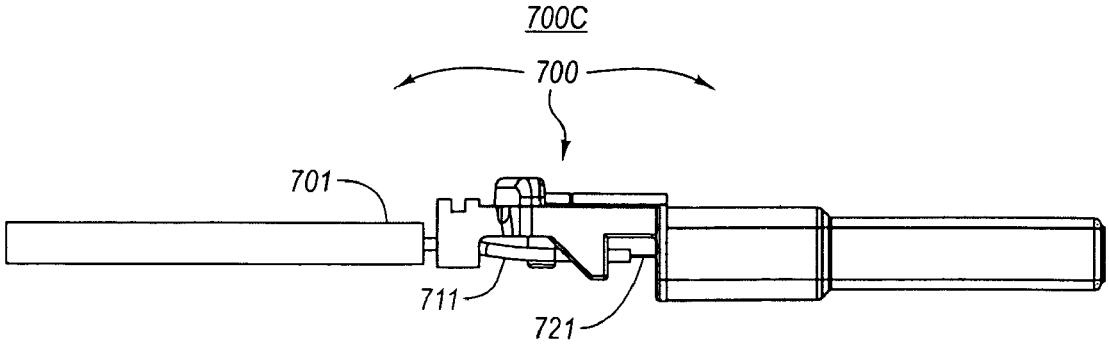
FIG. 7C illustrates a side view of the connector of FIG. 7A.

FIGS. 7A through 7C illustrate a respective bottom view 700A, back view 700B, and side view 700C of components 700 of the connector 100. The components 700 of FIGS. 7A through 7C add to the components 600 of FIGS. 6A and 6B in that an optical cable 701 is added. The optical cable 701 includes a transmit optical fiber 711 that passes through the cable insertion portion 413 of the plug chassis 401. Its corresponding fiber core 721 is optically coupled to the TOSA 201 in a manner that will be explained with respect to FIGS. 8 through 10D. The optical cable 701 also includes a receive optical fiber 712 that passes through the cable insertion portion 413 of the plug chassis 401. Its corresponding fiber core 722 is optically coupled to the ROSA 202 in a manner that will be explained with respect to FIGS. 8 though 10D. A post 730 is provided to allow a tensile member within the cable 701 to be wrapped and secured to the post 730, thereby inhibiting the cable 701 from being removed from the connector. However, various crimping mechanisms may suffice for this purpose.

Figure 8:
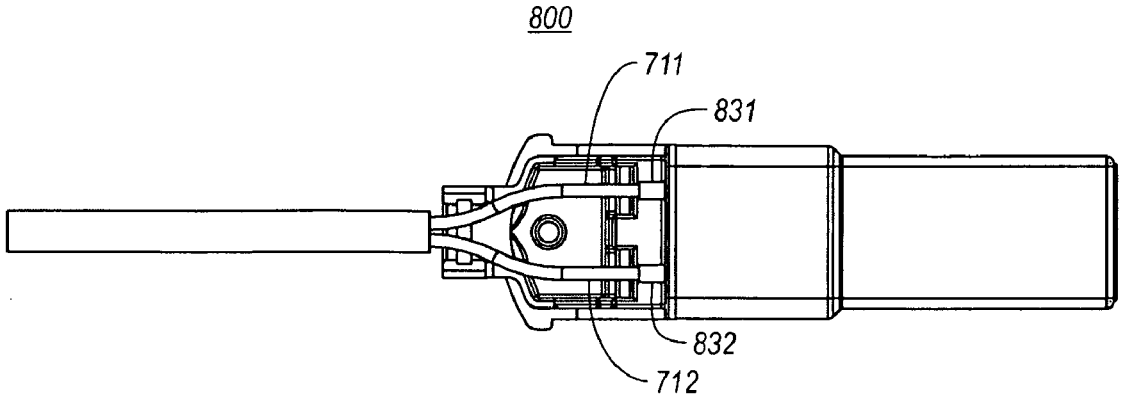
FIG. 8 illustrates a bottom view of the connector with ferrules added.

For a standard LC-type termination, an LC ferrule may be used to optically couple each of the fibers with their respective TOSA and ROSA. For example, FIG. 8 illustrates a bottom view of components 800 of the connector, which adds to the components 700 of FIGS. 7A through 7C in that the ferrules 831 and 832 are shown assisting the coupling of the fibers to the respective TOSA and ROSA.

Figure 9A:
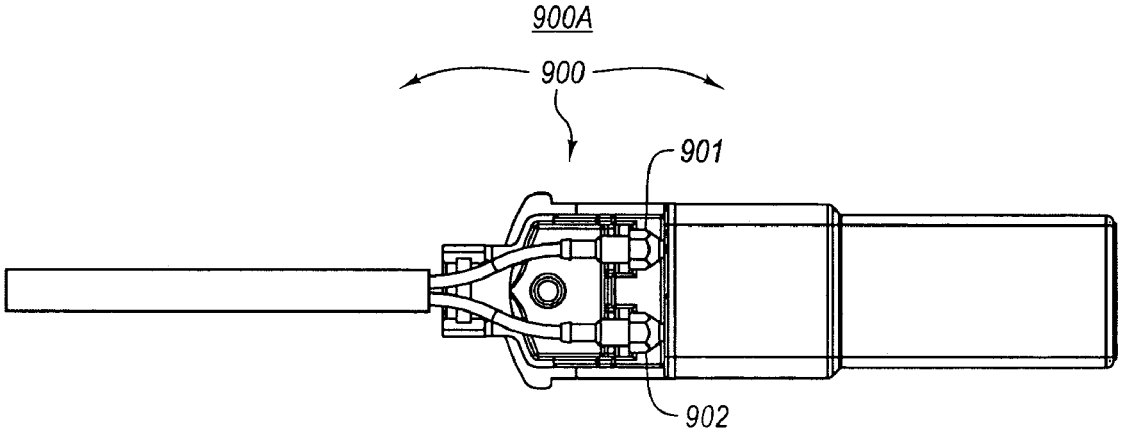
FIG. 9A illustrates a bottom view of the connector with ferrule holders added.
Figure 9B:
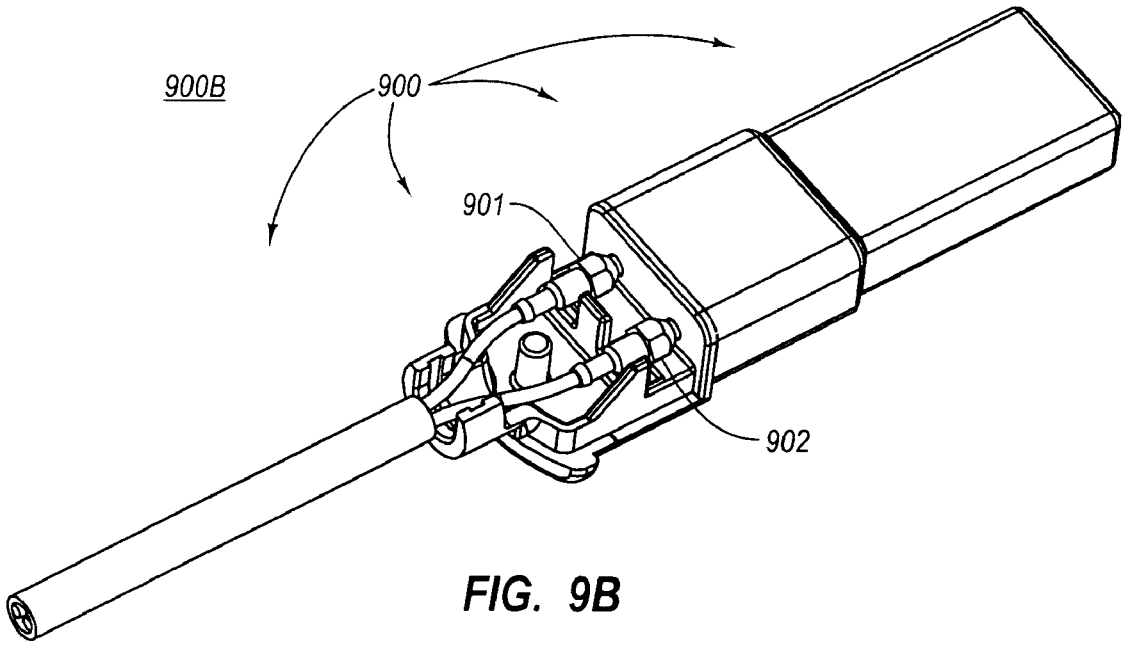
FIG. 9B illustrates a bottom rear perspective view of the connector of FIG. 9A.

FIGS. 9A and 9B illustrate a respective bottom view 900A, and a bottom rear perspective view 900B of components 900 of the connector. The components 900 of FIGS. 9A and 9B add to the components 800 of FIG. 8 in that ferrule holders 901 and 902 are added for the purpose of assisting in holding the underlying ferrules 831 and 832, respectively in place within their respective TOSA and ROSA. In actual assembly, the state illustrated in FIGS. 7A through 7C might not actually exist. Rather each of the fiber cores may be terminated as appropriate one at a time. For instance, in order to terminate each fiber, the appropriate ferrule may be coupled to the end of the fiber, and the ferrule holder position on the fiber. The ferrule may then be inserted into the appropriate TOSA or ROSA.

FIGS. 10A through 10D illustrate a respective side view 1000A, bottom view 1000B, bottom rear perspective view 1000C, and back view 1000D of components 1000 of the connector. The components 1000 of FIGS. 10A through 10D add to the components 900 of FIGS. 9A and 9B in that a ferrule spring clip 1001 is positioned in place to thereby apply a forward force to the ferrule holders 901 and 902. Thus, the ferrule holders 901 and 902 are able to hold the ferrules in place within the TOSA and ROSA, respectively. The ferrule holders (and thus the corresponding ferrules) are restrained from rotating due to their hexagonal shape, and due to the fact that one face of the hexagon is placed in close proximity to the plug chassis. The hexagonal shape also allows for a large bearing surface between the ferrule spring clip 1001 on the ferrule holders 901 and 902.

Figure 10A:
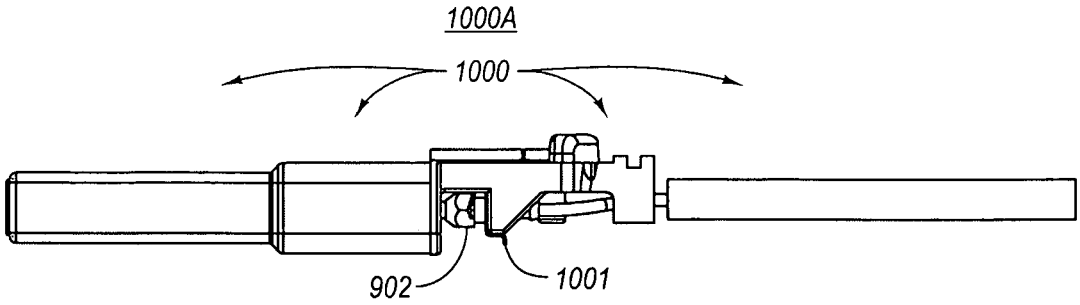
FIG. 10A illustrates a side view of the connector with a ferrule spring clip added.
Figure 10B:
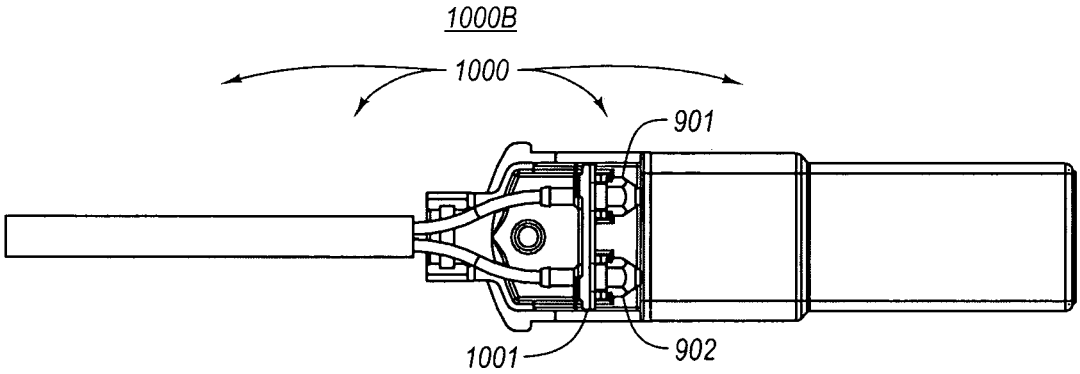
FIG. 10B illustrates a bottom view of the connector of FIG. 10A.
Figure 10C:
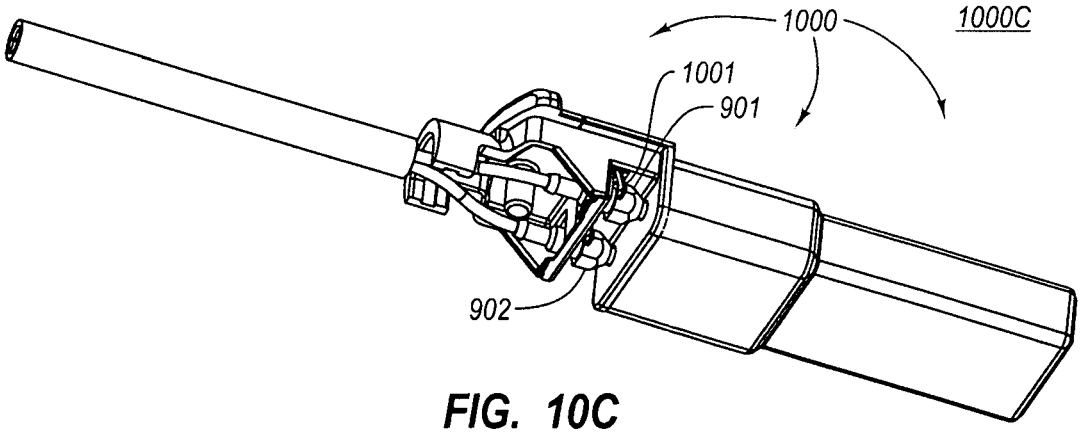
FIG. 10C illustrates a bottom rear perspective view of the connector of FIG. 10A.
Figure 10D:
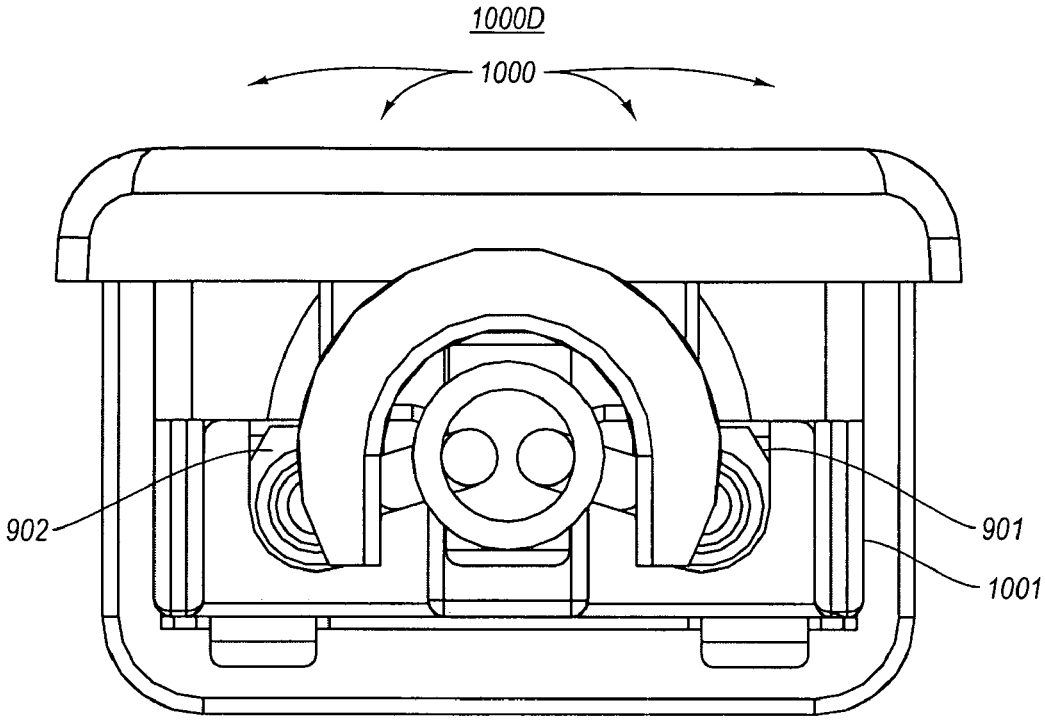
FIG. 10D illustrates a back view of the connector of FIG. 10A.
Figure 11:
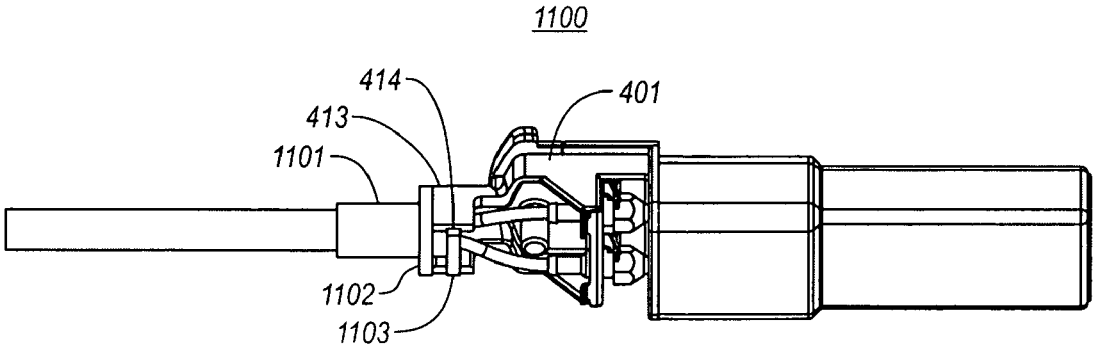
FIG. 11 illustrates a bottom perspective view of the connector with the bushing configured in place.

FIG. 11 illustrates a bottom perspective view of components 1100, which add to the components 1000 of FIGS. 10A and 10D, only in that the bushing 1101 is configured in place. The bushing 1101 includes a portion 1103 that inserts into the slot 414 of the plug chassis 401. The bushing also includes a flange 1102 that abuts against the cable insertion portion 413 of the plug chassis 401 when the portion 1103 is inserted into the slot 414.

Figure 12:
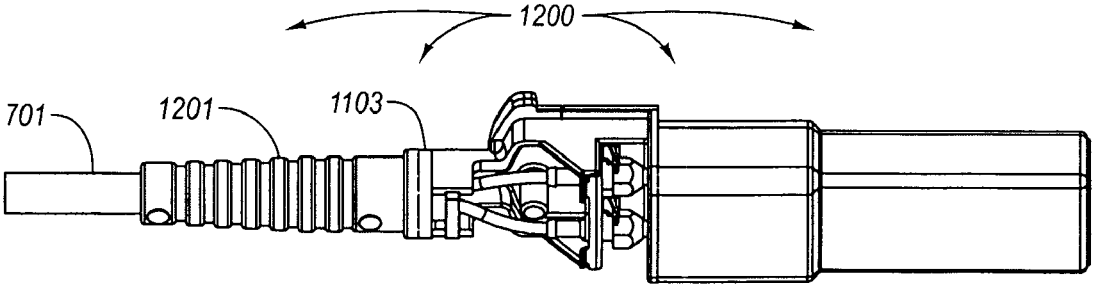
FIG. 12 illustrates a bottom perspective view of the connector with the strain relief boot in place.
Figure 13A:
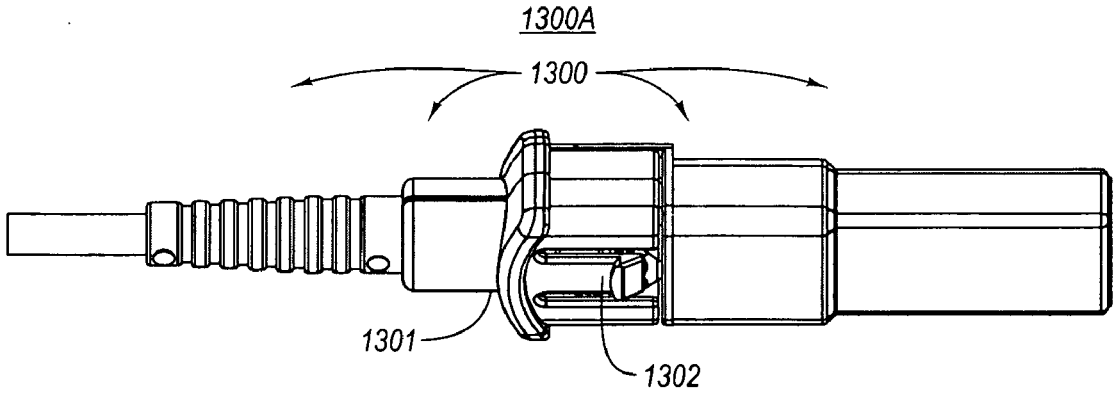
FIG. 13A illustrates a bottom perspective view of the connector with a backlatch component added.
Figure 13B:
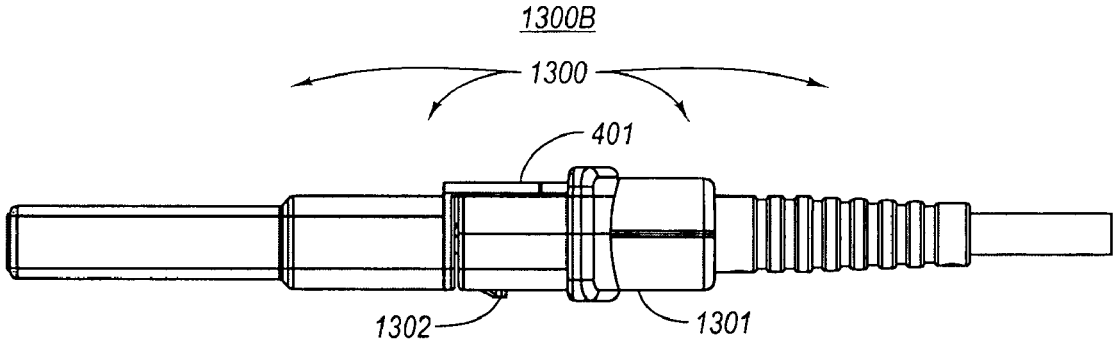
FIG. 13B illustrates a side view of the connector of FIG. 13A.
Figure 13C:
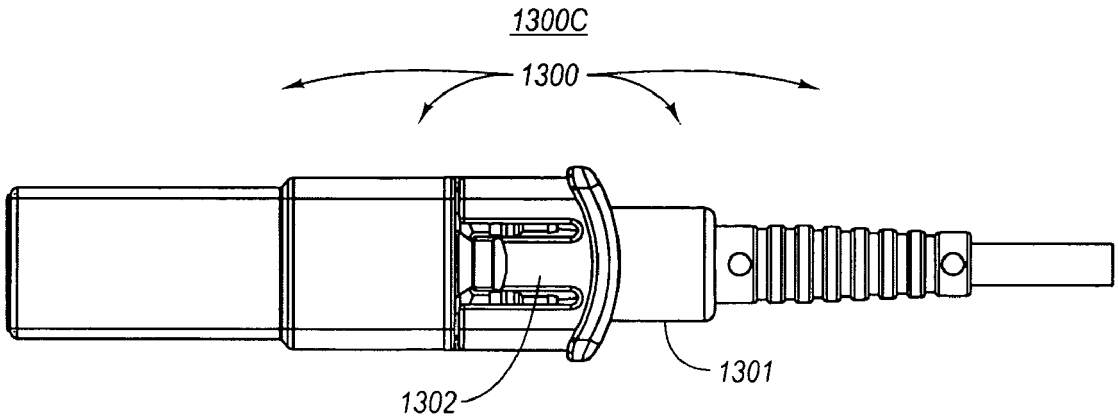
FIG. 13C illustrates a bottom view of the connector of FIG. 13A.
Figure 13D:
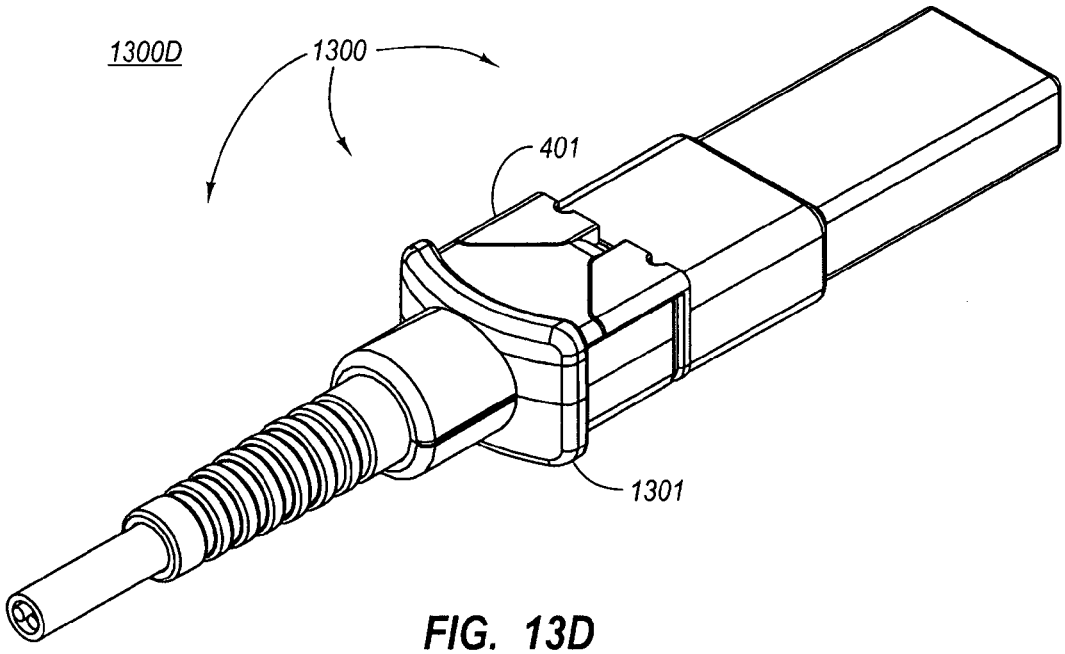
FIG. 13D illustrates a top rear perspective view of the connector of FIG. 13A.

FIG. 12 illustrates a bottom perspective view of components 1200, which add to the components 1100 of FIG. 11, in that a strain relief boot 1201 is pulled to abut the flange 1103 to thereby compression fit around the bushing 1101 (underneath the boot 1201 in FIG. 12). Both the bushing 1101 and the boot 1201 may be placed on the cable 701 prior to terminating the fibers in the TOSA and ROSA. That way, the bushing 1101 and cable 1201 need only be pulled forward guided by the cable 701 to be placed in proper position as described.

FIG. 13A through 13D illustrate a respective bottom perspective view 1300A, side view 1300B, bottom view 1300C, and top rear perspective view 1300C of the components 1300 of the connector. The components 1300 of FIGS. 13A through 13D add to the component 1200 of FIG. 12 in that backlatch component 1301 is slid up from the cable and positioned in place to provide an appropriate covering for the plug chassis 401. The backlatch component 1301 includes a latch 1302 which has some clearance to press downward towards the plug chassis.

As apparent from FIGS. 1A through 1C, the final step in the connector 100 assembly is to slide a latch piece 102 over the front of the connector. The latch piece 102 latches with the latch 1302 of the backlatch component 1301 to thereby snap into place, thereby completing the connector. Some of the internals of the connector could be reworked by sampling disengaging the latch 1302, removing the latch piece 102, and sliding back the backlatch 1301 component.

Accordingly, an embodiment of a connector has been described that permit for reduced EMI emissions for electromagnetic radiation originating from inside the connector.

Termination of Fiber

The connector shown in FIGS. 1 through 13D includes a termination of an optical fiber using a ferrule such as, for example, an LC ferrule. Such termination might be performed, for example, using a glass fiber. However, the principles of the present invention also extend to connectors in which plastic fiber is terminated and used within the connector.

When the fiber is glass or plastic, termination may be accomplished using different methods. For example, the cable may simply be cut to the correct length, with the cable protective layers removed the very end of the cable to expose the optical fibers. The fibers may then be cut cleanly perpendicular to the cable length. The fibers may then be inserted directly into the holes 411 and 412 of the plug chassis 401. In that embodiment, the diameter of the holes 411 and 412 would be different from that shown in FIGS. 4A through 4F to account for the difference in diameter between the naked fiber, and a ferrule. Furthermore, instead of a ferrule holding clip 1001, some other mechanism may be used to provide a forward bias to the fiber to thereby mechanically fix the fiber into the appropriate opening of the TOSA or ROSA. This termination may be accomplished in the field or at the time of cable manufacture.

In the described embodiments, the fiber termination occurs outside of the EMI barrier (defined by the plug chassis 401 on the back, the housing 341 on the front, and the sleeve 601 therebetween). Accordingly, the design of the fiber termination mechanism may be done with relative independence to the design of the EMI barrier. Furthermore, as previously mentioned, the fiber termination mechanism may be quite easily accessed by first removing the latch mechanism 102, and then removing the backshell mechanism 1301. That would expose the fiber, allowing for appropriate reworking of the fiber termination if desired, or perhaps for easy replacement of the connector itself.

Receptacle Design

Figure 14A:
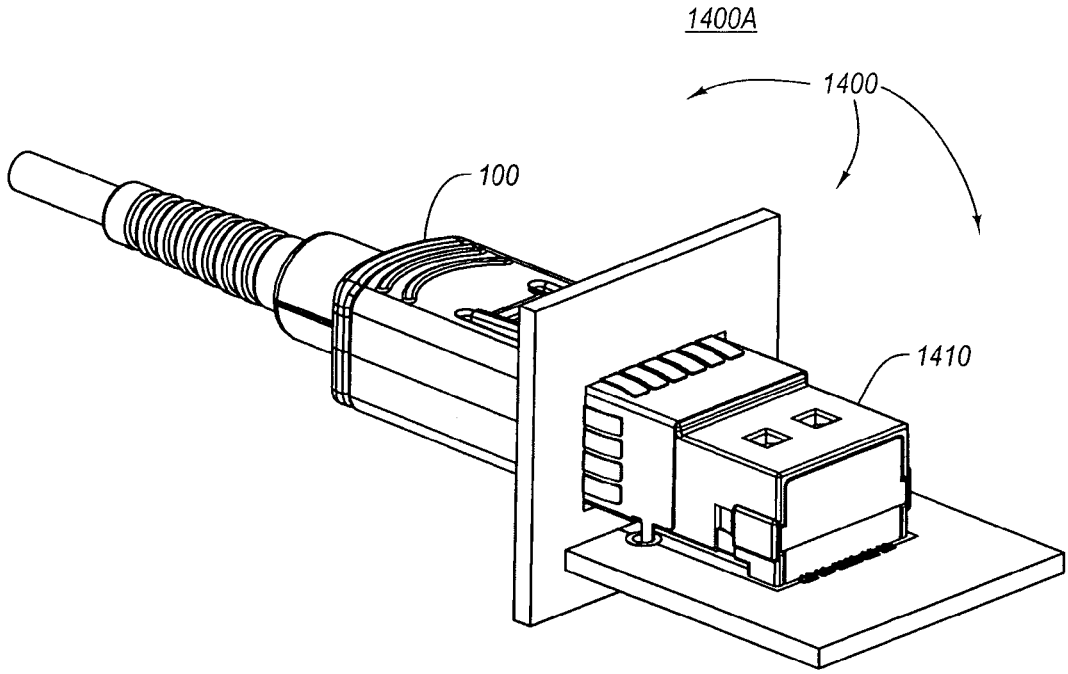
FIG. 14A illustrates a top front perspective view of a combination of the connector plugged into a receptacle.
Figure 14B:
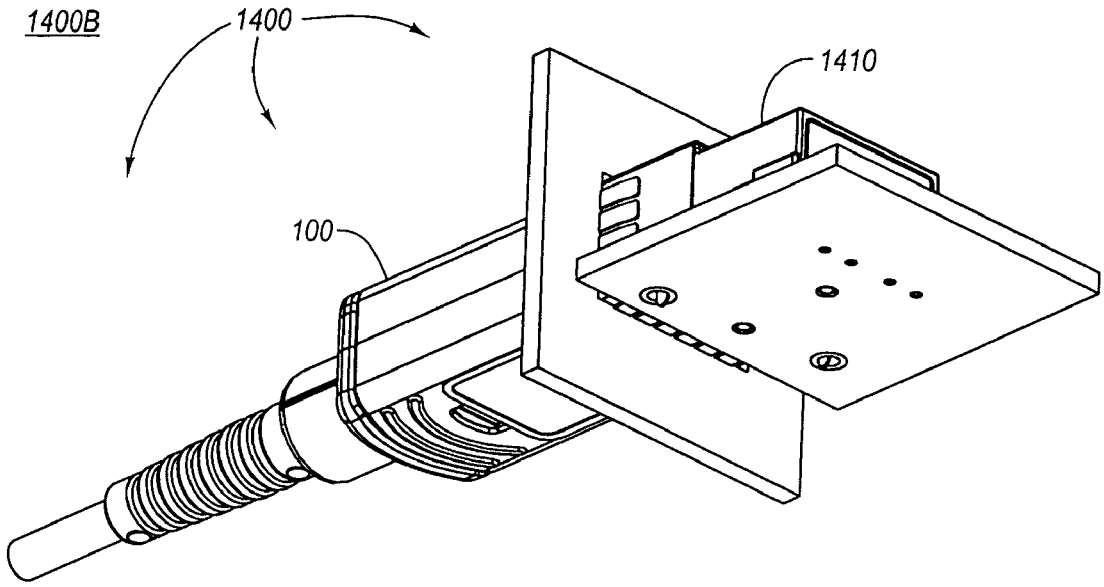
FIG. 14B illustrates a bottom front perspective view of the combination of FIG. 14A.
Figure 14C:
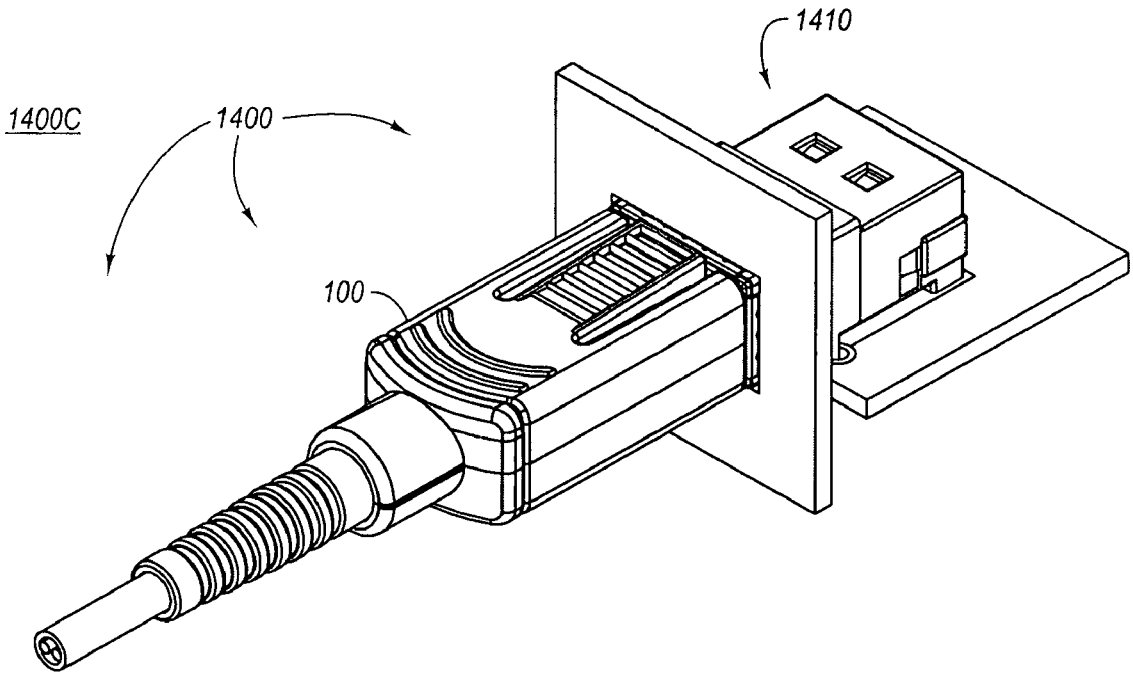
FIG. 14C illustrates a top rear perspective view of the combination of FIG. 14A.

FIGS. 14A through 14C illustrate a respective top front perspective view 1400A, a bottom front perspective view 1400B, and a top rear perspective view 1400C of a combination 1400 of the connector 100 as plugged into a corresponding receptacle 1410. The structure of the receptacle 1410 will be described with respect to FIGS. 15A through 18.

Figure 15A:
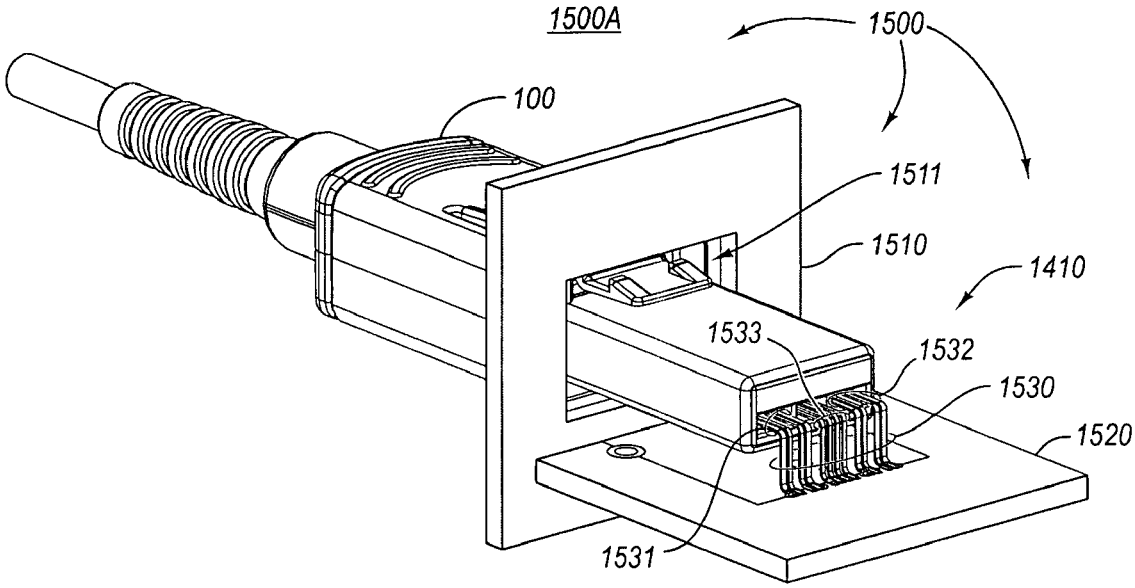
FIG. 15A illustrates a top front perspective view of the connector plugged into the receptacle, but with only the host panel, receptacle board, and contact array of the receptacle shown.
Figure 15B:
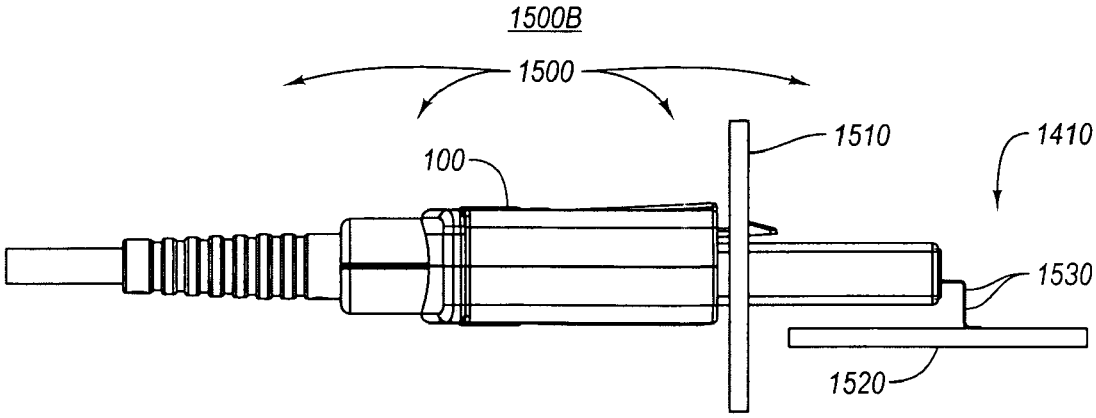
FIG. 15B illustrates a side view of the combination of FIG. 15A.
Figure 15C:
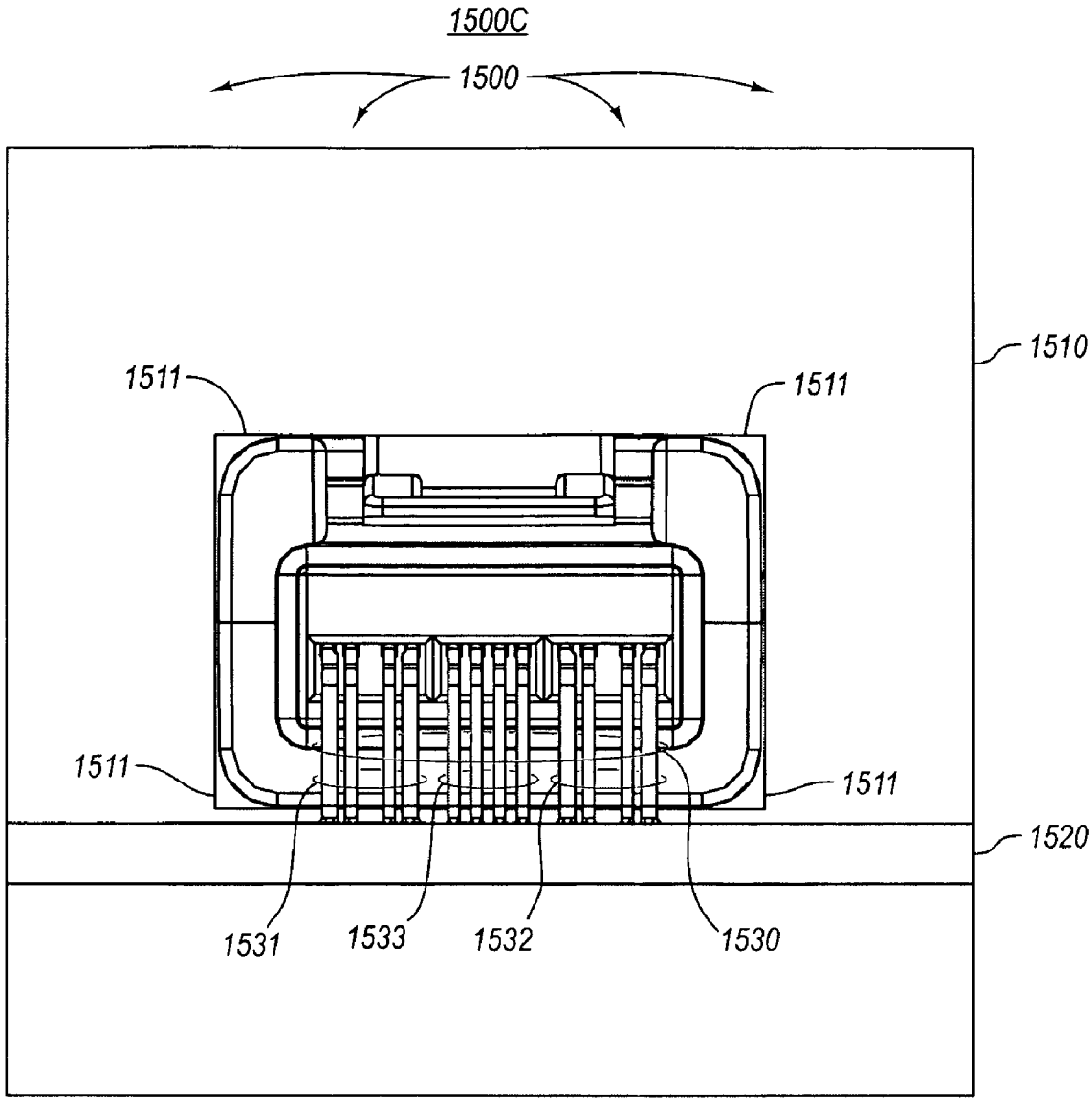
FIG. 15C illustrates a front view of the combination of FIG. 15A.

FIGS. 15A, 15B and 15C illustrate a respective top front perspective view 1500A, a side view 1500B, and front view 1500C of the combination 1500 of the connector 100 interfacing with components of the receptacle 1410. Specifically, only three of the receptacle components are illustrated; namely, a host panel 1510, a receptacle board 1520, and a contact array 1530 of receptacle side electrical contacts.

The host panel 1510 may represent only a portion of a physical panel of the host into which the connector 100 is plugged. The receptacle board 1520 may be, for example, a printed circuit board, that may include electrical traces (not shown) for routing electrical signals and power to and from the contact array 1530.

Only a few components of the receptacle are shown in FIGS. 15A through 15C. The receptacle would also include a mechanism for supporting the connector 100 as the connector is plugged into the receptacle, a locking mechanism for interfacing with the latch 102 of the connector 100, a mechanism for structurally supporting the contact array 1530, and other components as will be apparent from the subsequent description of FIGS. 16A through 18.

As the connector 100 is plugged into the receptacle 1410, the connector 100 passes through the hole 1511 in the host panel 1510, and is guided by structural pieces (not shown in FIGS. 15A through 15C) in the receptacle. In addition, the latch mechanism 102 locks into place when the connector is fully connected. Furthermore, the contact array 1530 of the receptacle is electrically coupled with the corresponding contact array 206 (see FIG. 2D). Specifically, one group of contacts 1531 of the contact array 1530 is passed into hole 311 (see FIG. 3F) to contact connector-side electrical contact group 301 (see FIGS. 3A through 3G), another group of contacts 1532 of the contact array 1530 is passed into hole 312 to contact connector-side electrical contact group 302, and a final group of contacts 1533 of the contact array 1530 is passed into hole 313 to contact connector-side electrical contact group 343. Thus, full mechanical interfacing and locking is achieved while providing electrical contact with the receptacle.

Figure 16A:
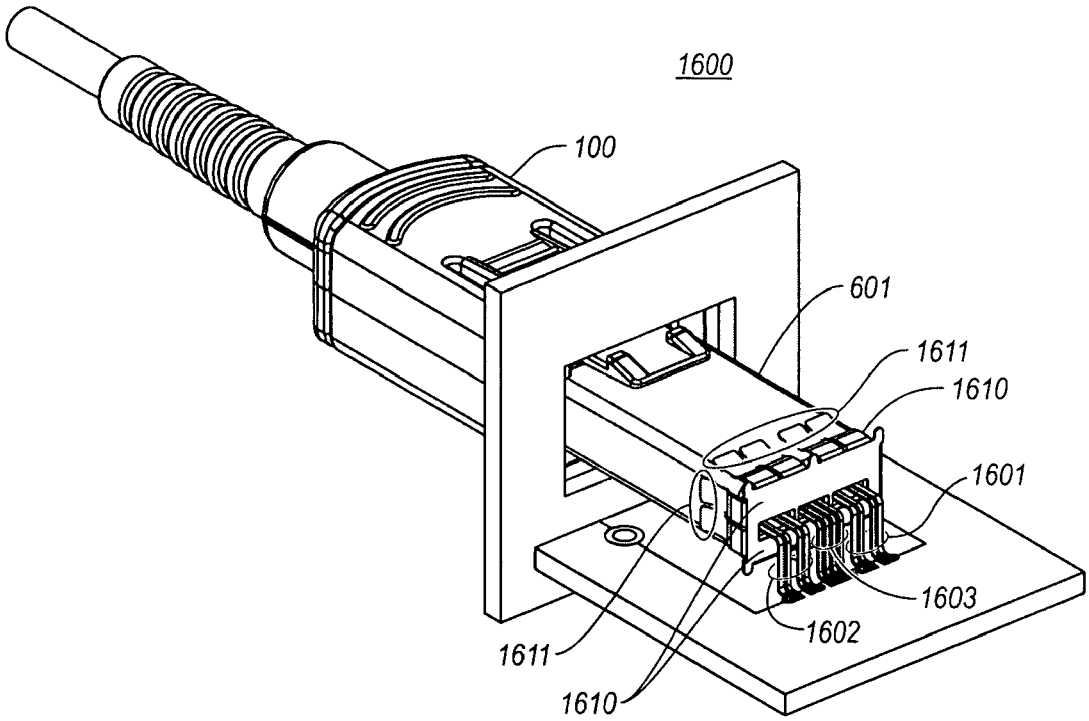
FIG. 16A illustrates a top front perspective view of the combination of FIG. 15A, but with a socket shield added.

FIG. 16A illustrates a top front perspective view of a combination 1600 of the connector 100 plugged into the receptacle 1410. The receptacle shows the same components as were illustrated in FIGS. 15A through 15C, but further includes a socket shield 1610. The socket shield 1610 serves as a component of the EMI barrier between the host and the ambient environment. In addition, as mentioned above, the socket shield 1610 completed the EMI shield of the connector, thereby serving as an EMI barrier between the connector, and the host environment as well. The socket shield 1610 may be composed of conductive material, such as metal, and includes several fingers 1611 that make electrical contact with the sleeve 601 of the connector 100, when the connector 100 is plugged into the receptacle. The socket shield 1610 extends to cover the front of the connector housing 341 (introduced in FIGS. 3A through 3G), except at the area of openings 311 through 313. These small openings in the socket shield are the largest openings in the connector and host EMI barrier and serve to limit EMI better than a single large opening would. The smaller openings are facilitated by the breaking up of the electrical contacts into three spatially distinct groupings as described above with respect to FIGS. 3A through 3E.

The receptacle-side contact set 1531 contacts the connector-side contact set 301 to form a first set of electrical connections through the hole 1601 in the socket shield 1610. The receptacle-side contact set 1532 contacts the connector-side contact set 302 to form a second set of electrical connections through the hole 1602 in the socket shield 1610. Also, the receptacle-side contact set 1533 contacts the connector-side contact set 303 to form a third set of electrical connections through the hole 1603 in the socket shield 1610. The socket shield covers the connector housing 341 which had represented the largest EMI barrier opening of the connector prior to the connector being plugged in. With the connector plugged in, the socket shield 1610 covers the connector housing 341. Thus, the EMI barrier opening at the front of the connector is made into three much smaller EMI barrier openings. Although the EMI barrier openings at holes 1601 through 1603 are still perhaps the largest EMI barrier openings at the connector, the EMI protection afforded the connector may be significantly improved by the presence of the receptacle-side socket shield 1610.

Figure 16B:
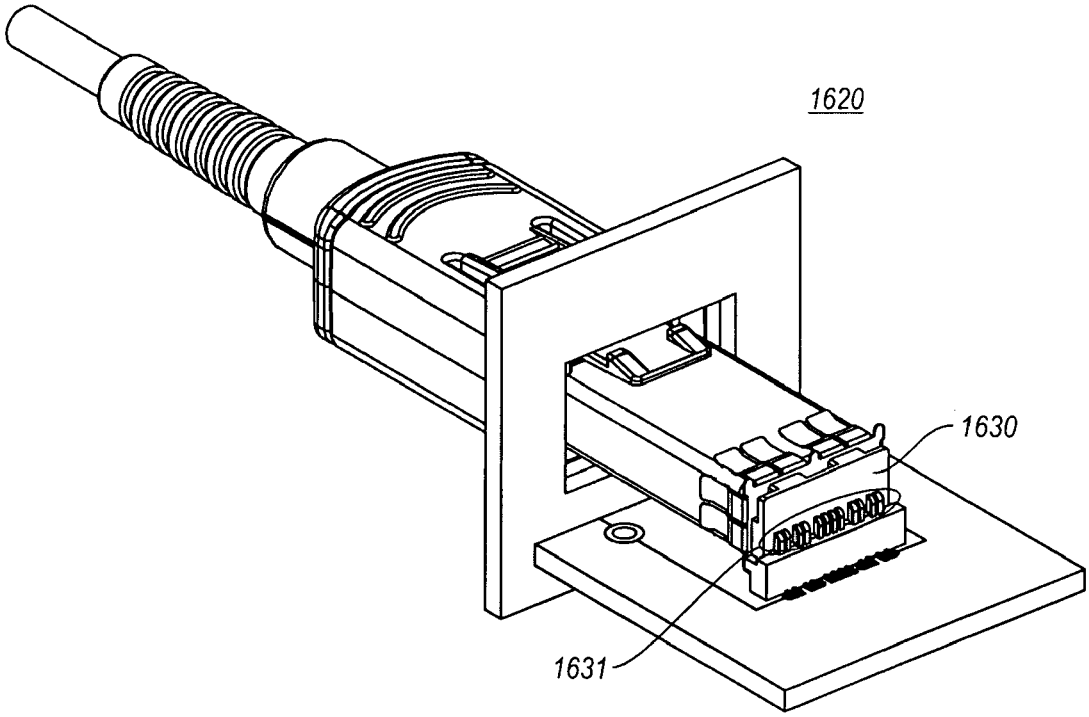
FIG. 16B illustrates a top front perspective view of the combination of FIG. 16A, but with the contact body shown.

FIG. 16B illustrates a top front perspective view of a combination 1620 that is the same as the combination 1600 of FIG. 16A, except that a contact body 1630 is shown. The contact body 1630 may be insert molded around the receptacle contacts. However, a portion of the contacts 1631 is left exposed to facilitate effective insert molding.

Figure 16C:
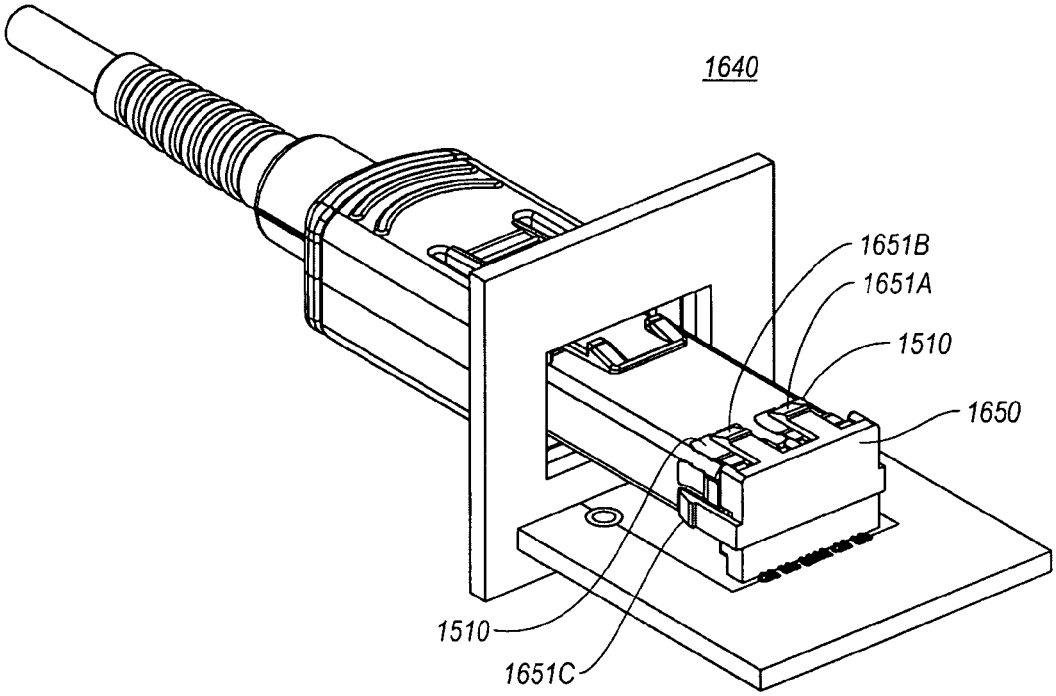
FIG. 16C illustrates a top front perspective view of the combination of FIG. 16B, but with the contact cover added.

FIG. 16C illustrates a top front perspective view of a combination 1640 that is the same as the combination 1620 of FIG. 16B, except that a contact cover 1650 is shown. The contact cover 1650 covers the previously exposed portion 1631 of the contacts, and also extends over the end of the socket shield 1510. The contact cover 1650 also includes several prongs 1651A, 1651B, 1651C, and so forth (two on the top, and one on each side).

Figure 17:
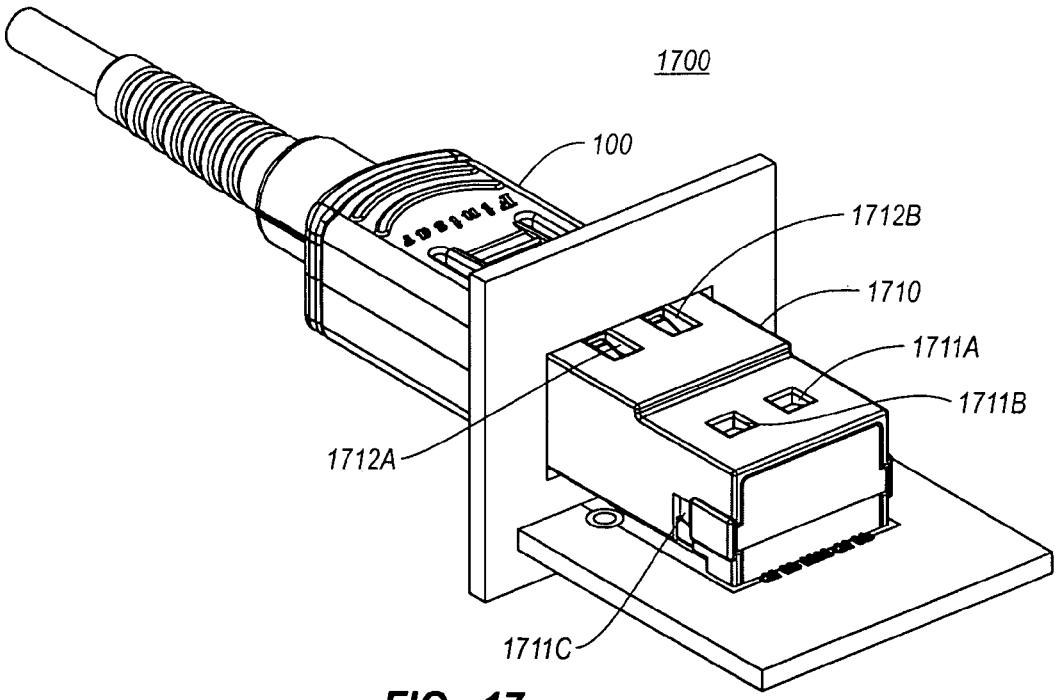
FIG. 17 illustrates a top front perspective view of the combination of FIG. 16C, but with a receptacle housing shown.

FIG. 17 illustrates a top front perspective view of a combination 1700 that is the same as the combination 1640 of FIG. 16C, except that receptacle housing 1710 is disposed around the receptacle as shown. The receptacle housing 1710 provides further EMI protection. The receptacle housing 1710 also provides mechanical guidance for the plug 100 as it is received into the receptacle. The socket housing includes holes 1711A, 1711B, 1711C, and so forth, that receive respective prongs 1651A, 1651B, 1651C, and so forth, of the contact cover 1650. This mechanically locks the socket housing 1710 to the contact cover 1650. The socket housing 1710 also includes two locking indentures 1712A and 1712B to receive the locking prongs of the locking mechanism 102 of the connector 100. This serves to latch the connector 100 in place when plugged into the receptacle.

Figure 18:
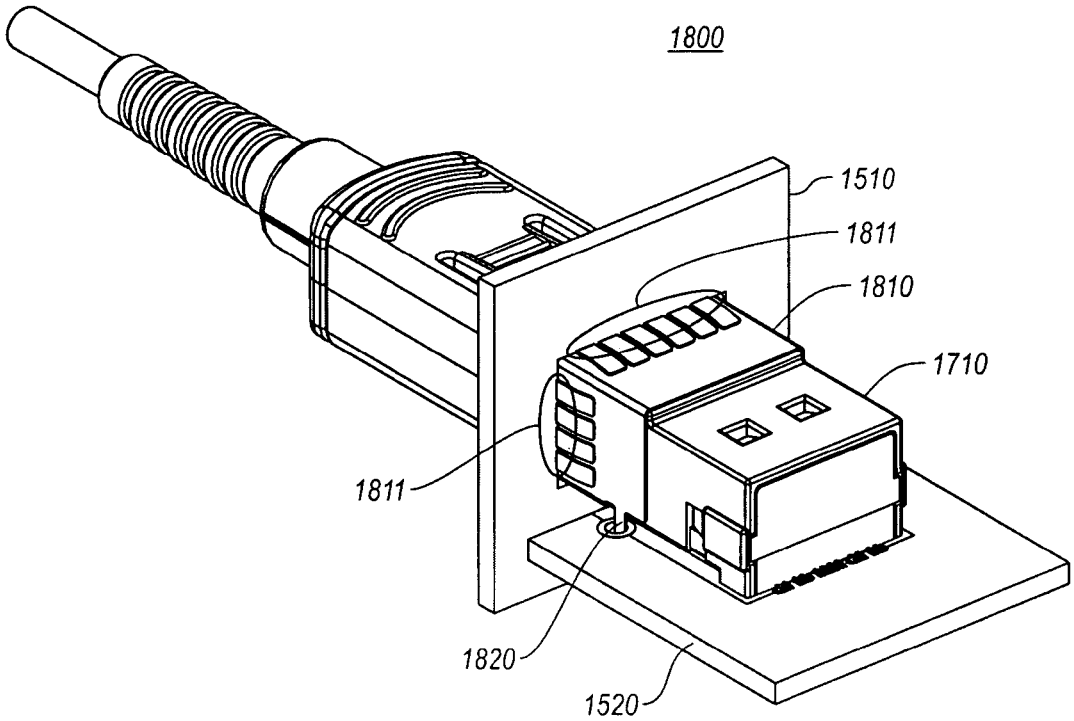
FIG. 18 illustrates a top front perspective view of the combination of FIG. 17, but with a host shield shown.

FIG. 18 illustrates a top front view of a combination 1800 that is the same as the combination 1700 of FIG. 17, except that a host shield 1810 is disposed thereon. The host shield 1810 includes fingers 1811 that are bent back and placed in electrical contact with the host panel 1510. The host shield 1810 is fixed at some voltage through a voltage pin 1820 in the host board 1520. For example, the host shield 1810 may be grounded. This shield serves to prevent any other emissions generated inside the host chassis from escaping through the panel opening. The details of the fingers are such that the openings are of small enough dimensions to greatly attenuate any emission.

The receptacle housing 1710 makes electrical contact with the host shield 1810 and the socket shield 1610. The receptacle housing 1710, in combination with the host shield 1810 and the socket shield 1610 provide an effective EMI barrier between the host and the environment, regardless of whether or not the connector 100 is plugged in. In addition, the socket shield 1610 serves to complete the EMI containment of the plug when it is inserted.

Connector with SFP Adaptor

Figure 19:
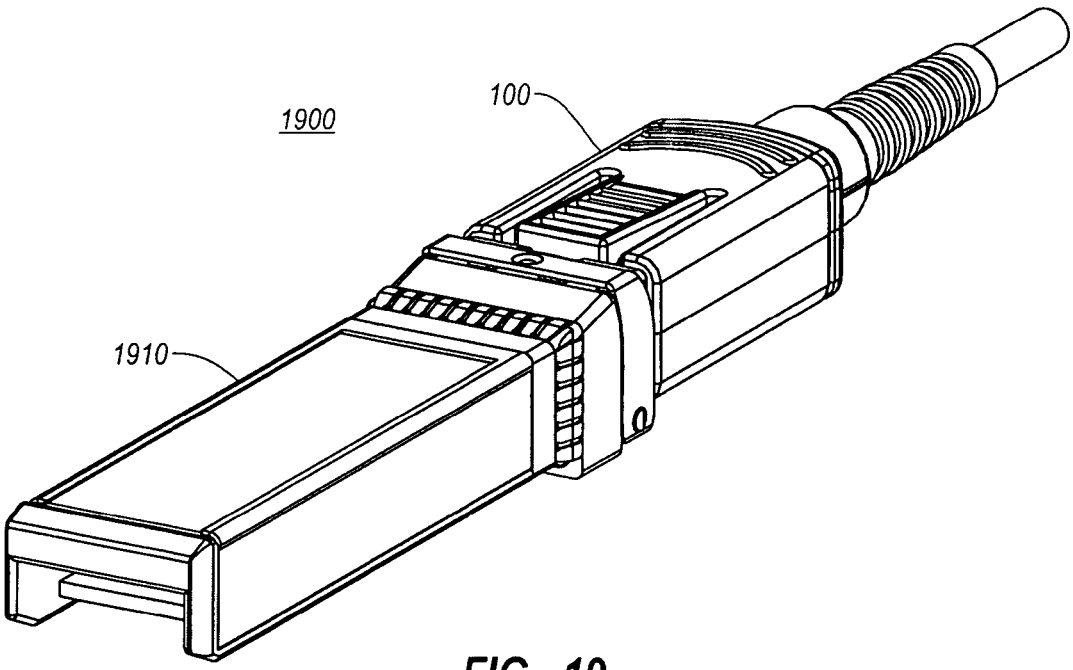
FIG. 19 shows a top front perspective view of the combination of the connector plugged into an SFP adaptor.
Figure 20:
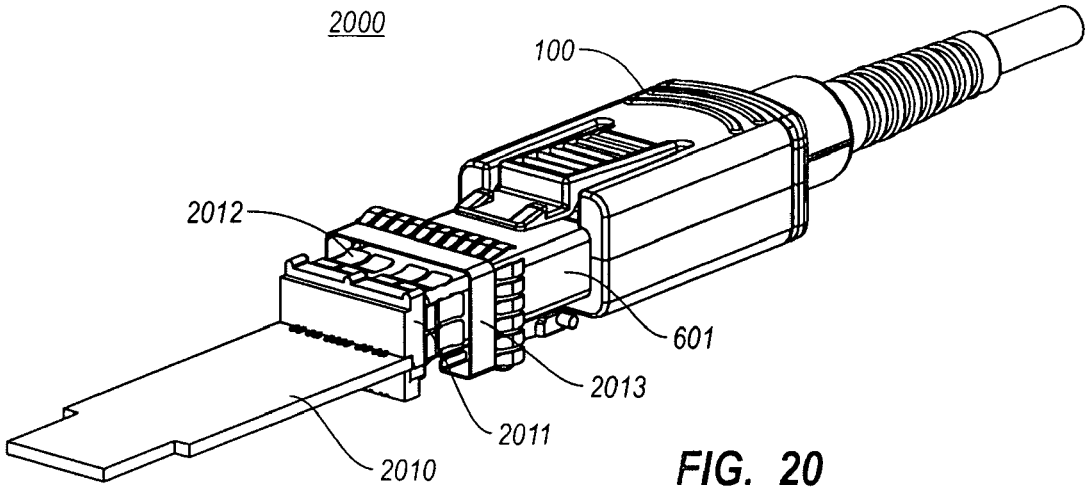
FIG. 20 illustrates a top front perspective view of the connector in conjunction with several internal portions of the SFP adaptor.

FIG. 19 through 22 show various adaptors that may be used with the connector 100. Specifically, FIGS. 19 and 20 show the connector 100 interfacing with an SFP adaptor. FIG. 19 shows a top front perspective view of the combination 1900 of the connector 100 plugged into an SFP adaptor 1910. SFP stands for the Small Formfactor Pluggable (SFP) standard, which refers in turn to a fiber optic transceiver meeting certain mechanical and electrical specifications and is commonly used in data communications and telecommunication applications up to approximately 4 Gb/s However, SFP is intended to cover all derivatives of the SFP standard such as SFP+ which is presently used for datarates of 8-10 Gb/s. The connector may be plugged into an adaptor between the signals of the connector 100 (which may be proprietary) into signals satisfying particular fiber-optic transceiver standards, such as, for example, XFP, X2, XPAK, or XENPAK which are each used for fiber optic transmission at data rates of approximately 10 Gb/s. Accordingly, although the adaptor is described as being a suitable SFP adaptor with suitable modifications to interface with the connector 100, other standard adaptors with other similar modifications may be used to adapt between the connector 100 and other connector standards, as will be apparent to those of ordinary skill in the art after having read this description.

FIG. 20 illustrates a top front perspective view 2000 of the connector 100 in conjunction with several internal potions of the SFP adaptor. Specifically, adaptor circuit board 2010, contact body 2011 encapsulating contacts, socket shield 2012, and receptacle shield 2013 are shown. The remainder of the components of the adaptor may be standard SFP adaptor pieces.

Connector with XFP Adaptor

Figure 21:
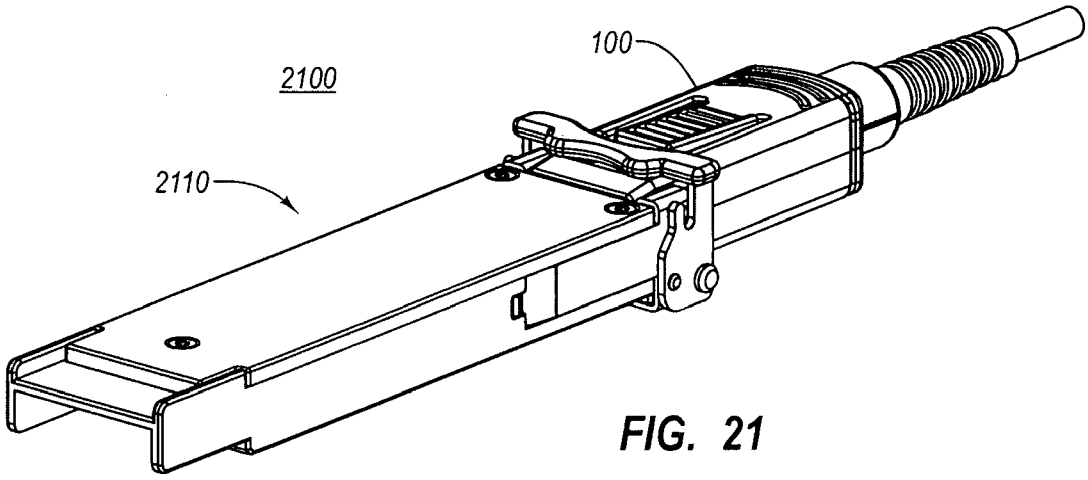
FIG. 21 shows a top front perspective view of the combination of the connector plugged into an XFP adaptor.
Figure 22:
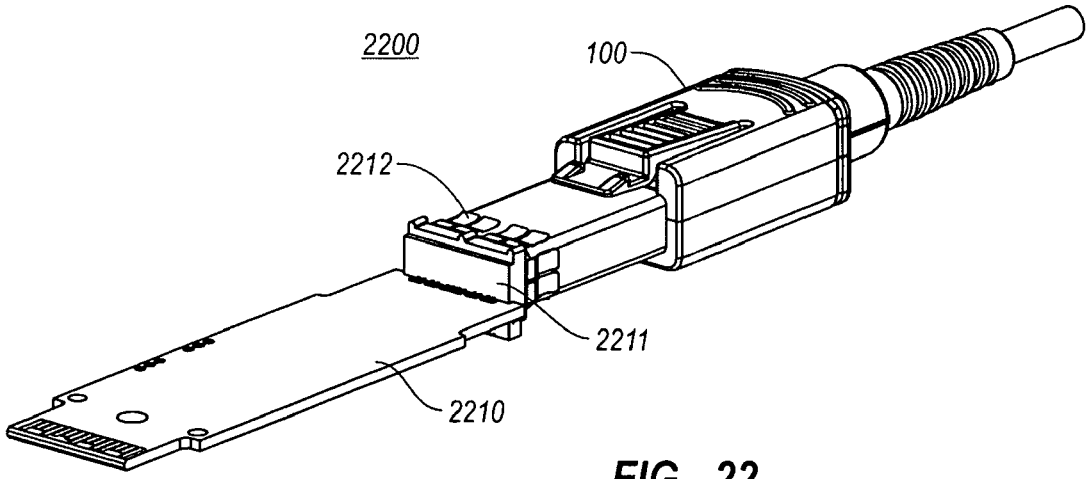
FIG. 22 illustrates a top front perspective view of the connector in conjunction with several internal portions of the XFP adaptor.

FIGS. 21 and 22 show the connector 100 interfacing with an XFP adaptor. FIG. 21 shows a top front perspective view of the combination 2100 of the connector 100 plugged into an XFP adaptor 21100. FIG. 22 illustrates a top front as perspective view 2200 of the connector 100 in conjunction with several internal potions of the XFP adaptor. Specifically, adaptor circuit board 2210, contact body 2211 encapsulating contacts, and socket shield 2212 are shown. The remainder of the components of the adaptor may be standard XFP adaptor pieces.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electrical connector receptacle comprising:

a plurality of receptacle-side electrical contacts;

a socket into which a connector may be inserted, wherein when the connector is inserted into the socket, electrical contacts of the connector contact the plurality of receptacle-side contacts; and a receptacle shield placed in the back of the receptacle, wherein the receptacle shield is composed of an Electro-Magnetic Interference barrier material, the receptacle shield having at least a first and a second EMI barrier opening, wherein when the connector is plugged into the socket, a first set of electrical connections is made through a first EMI barrier opening between a first set of the receptacle-side contacts and a first set of connector-side contacts, and a second set of electrical connections is made through a second EMI barrier opening between a second set of receptacle-side contacts and a second set of connector-side contacts.

2. The electrical connector receptacle of claim 1, wherein when the connector is plugged into the socket, the receptacle shield is configured to make electrical contact with an EMI shield of the connector.

3. The electrical connector receptacle of claim 1, wherein the receptacle shield includes a third EMI barrier opening, wherein when the connector is plugged into the socket, a third set of electrical connections is made through a third EMI barrier opening between a third set of the receptacle-side contacts and a third set of connect-side contacts.

4. The electrical connector receptacle of claim 1, wherein the receptacle is an adaptor.

5. The electrical connector receptacle of claim 4, wherein the receptacle is an XFP adaptor.

6. The electrical connector receptacle of claim 4, wherein the receptacle is an SFP adaptor.

7. The electrical connector receptacle of claim 1, further comprising:

a mechanism for mechanically connecting the receptacle to a host.

8. The electrical connector receptacle of claim 1, wherein the first set of electrical connections comprise differential transmit signals, and the second set of electrical connections comprise differential receive signals.

9. The electrical connector receptacle of claim 1, further comprising:

a receptacle side EMI barrier, which in conjunction with the receptacle shield services an EMI barrier between the host that contains the receptacle and the environment even when a connector is not plugged into the receptacle.

10. A system comprising:

a receptacle having an electrical interface, and a receptacle shield that is placed in the back of a socket of the receptacle, wherein the receptacle shield is composed of an Electro-Magnetic Interference barrier material, the receptacle shield having at least a first and a second EMI barrier opening; and a connector having an electrical interface for plugging into the socket of the receptacle, wherein when the connector is plugged into the socket of receptacle, the receptacle shield electrically engages with an EMI shield of the connector, wherein when then EMI shield of the connector combines with the receptacle shield, the first and second EMI barrier openings are the largest EMI discontinuities of the combined shield.

11. The system of claim 10, wherein the system further comprising:

a host system, wherein the receptacle is a first receptacle and is mechanically and electrically coupled to the host system; and a plurality of other receptacles, at least some of which being structured the same as recited for the first receptacle.

12. The system of claim 10, wherein the electrical connector comprises an optical cable extending from its back end.

13. The system of claim 10, wherein the receptacle is an adaptor.

14. The system of claim 13, wherein the receptacle is an XFP adaptor.

15. The system of claim 13, wherein the receptacle is an SFP adaptor.

* * * * *